US009587343B2

(12) United States Patent
Jang et al.

(10) Patent No.: US 9,587,343 B2
(45) Date of Patent: Mar. 7, 2017

(54) CONTROL METHOD OF LAUNDRY MACHINE

(75) Inventors: Jae Hyuk Jang, Seoul (KR); Bon Kwon Koo, Seoul (KR); Young Suk Kim, Seoul (KR); Hyun Seok Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 1059 days.

(21) Appl. No.: 13/392,669

(22) PCT Filed: Aug. 27, 2010

(86) PCT No.: PCT/KR2010/005820
§ 371 (c)(1),
(2), (4) Date: Feb. 27, 2012

(87) PCT Pub. No.: WO2011/025324
PCT Pub. Date: Mar. 3, 2011

(65) Prior Publication Data

US 2012/0151692 A1 Jun. 21, 2012

(30) Foreign Application Priority Data

Aug. 27, 2009 (KR) ..... 10-2009-0079908
Aug. 27, 2009 (KR) ..... 10-2009-0079912
(Continued)

(51) Int. Cl.
*D06F 33/02* (2006.01)
*D06F 37/22* (2006.01)
(Continued)

(52) U.S. Cl.
CPC ..... *D06F 37/225* (2013.01); *D06F 35/007* (2013.01); *D06F 37/203* (2013.01);
(Continued)

(58) Field of Classification Search
CPC .... D06F 37/203; D06F 35/005; D06F 35/007; D06F 2222/00; D06F 2202/12;
(Continued)

(56) References Cited

U.S. PATENT DOCUMENTS 4,054,412 A * 10/1977 Brummett et al. ..... 8/158
2007/0124871 A1 6/2007 Kwon et al.
(Continued)

FOREIGN PATENT DOCUMENTS

CN 1724742 A 1/2006
CN 101177872 A 5/2008
(Continued)

OTHER PUBLICATIONS

International Search Report dated Feb. 25, 2011 issued in Application No. PCT/KR2010/005820.
(Continued)

*Primary Examiner* — Michael Barr
*Assistant Examiner* — Irina Graf
(74) *Attorney, Agent, or Firm* — KED & Associates LLP

(57) ABSTRACT

Disclosed is a control method of a laundry machine. The control method of a laundry machine included with a balancer for performing a balancing step at least three times in a spinning cycle, the control method comprising a step configured to balance the drum at least one time before and while a rotation speed of the drum passes a transient region, a step configured to determine an irregular vibration region of the laundry machine and a balancing step implemented at least one time before a rotation speed of a drum enters the irregular vibration region, while the rotation speed is passing the irregular vibration region and after the rotation speed passes the irregular vibration region.

9 Claims, 18 Drawing Sheets

(30) Foreign Application Priority Data

Aug. 27, 2009 (KR) ..... 10-2009-0079923
Aug. 27, 2009 (KR) ..... 10-2009-0080125

(51) Int. Cl.
*D06F 35/00* (2006.01)
*D06F 37/20* (2006.01)
*D06F 37/24* (2006.01)

(52) U.S. Cl.
CPC ..... *D06F 37/245* (2013.01); *D06F 2222/00* (2013.01); *D06F 2232/08* (2013.01)

(58) Field of Classification Search
CPC ..... D06F 2204/06; D06F 2204/065; D06F 37/225; D06F 37/245; D06F 2202/065
See application file for complete search history.

(56) References Cited

U.S. PATENT DOCUMENTS

| | | | | |
|---|---|---|---|---|
| 2008/0172805 | A1* | 7/2008 | Na | D06F 35/007 8/159 |
| 2008/0301884 | A1* | 12/2008 | Lee et al. | 8/159 |
| 2009/0071200 | A1* | 3/2009 | Chang | 68/140 |
| 2009/0183318 | A1* | 7/2009 | Kim | D06F 37/225 8/159 |

FOREIGN PATENT DOCUMENTS

| | | | |
|---|---|---|---|
| CN | 101177881 | A | 5/2008 |
| CN | 101492874 | A | 7/2009 |
| EP | 1 619 286 | | 1/2006 |
| EP | 1 918 447 | | 5/2008 |
| EP | 1 921 197 | | 5/2008 |
| EP | 2 000 576 | A2 | 12/2008 |
| EP | 2 083 109 | A1 | 7/2009 |
| JP | 05-184769 | | 7/1993 |
| JP | 2005-342274 | | 12/2005 |
| KR | 20-0154059 | | 8/1999 |
| KR | 10-2004-0058999 | A | 7/2004 |
| KR | 10-2005-0115764 | A | 12/2005 |
| KR | 10-2006-0009075 | A | 1/2006 |
| KR | 10-2008-0069857 | A | 7/2008 |
| KR | 10-2008-0094290 | A | 10/2008 |
| KR | 10-2008-0107097 | A | 12/2008 |
| KR | 10-2009-0080608 | A | 7/2009 |

OTHER PUBLICATIONS

European Search Report dated Dec. 18, 2014 issued in Application No. 10812337.3.
Chinese Office Action dated Jan. 30, 2014 issued in Application No. 201080042201.8 with English translation).
Russian Notice of Allowance dated Sep. 17, 2013 issued in Application No. 2012111674 (with English translation).

* cited by examiner (a)

(b)

(c)

CONTROL METHOD OF LAUNDRY MACHINE

CROSS-REFERENCE TO RELATED PATENT APPLICATIONS

This application is a U.S. National Stage Application under 35 U.S.C. §371 of PCT Application No. PCT/KR2010/005820, filed Aug. 27, 2010, which claims priority to Korean Patent Application Nos. 10-2009-0079908, filed Aug. 27, 2009, 10-2009-007923, filed Aug. 27, 2009, 10-2009-0079912, filed Aug. 27, 2009 and 10-2009-0080125, filed Aug. 27, 2009.

TECHNICAL FIELD

The present invention relates to a control method of a laundry machine.

BACKGROUND ART

In general, a laundry machine may include washing, rinsing and spinning cycles. Here, the spinning cycle includes a rotating step of rotating a drum provided in such a laundry machine at the highest RPM. Because of the step, the spinning cycle would generate noise and vibration quite a lot, which is required to be solved in the art the prevent invention pertains to.

DISCLOSURE OF INVENTION

Technical Problem

Accordingly, the present invention is directed to a control method of a laundry machine.

An object of the present invention is to provide a control method of a laundry machine which can solve the above problem.

Solution to problem

To solve the problems, an object of the present invention is to provide a control method of a laundry machine provided with a balancer, the control method comprising balancing step performed at least three times in a spinning cycle.

Advantageous effects of invention

According to the control method of the present invention, noise of the laundry machine can be reduced effectively when the spinning cycle is carried out.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Figure 1:
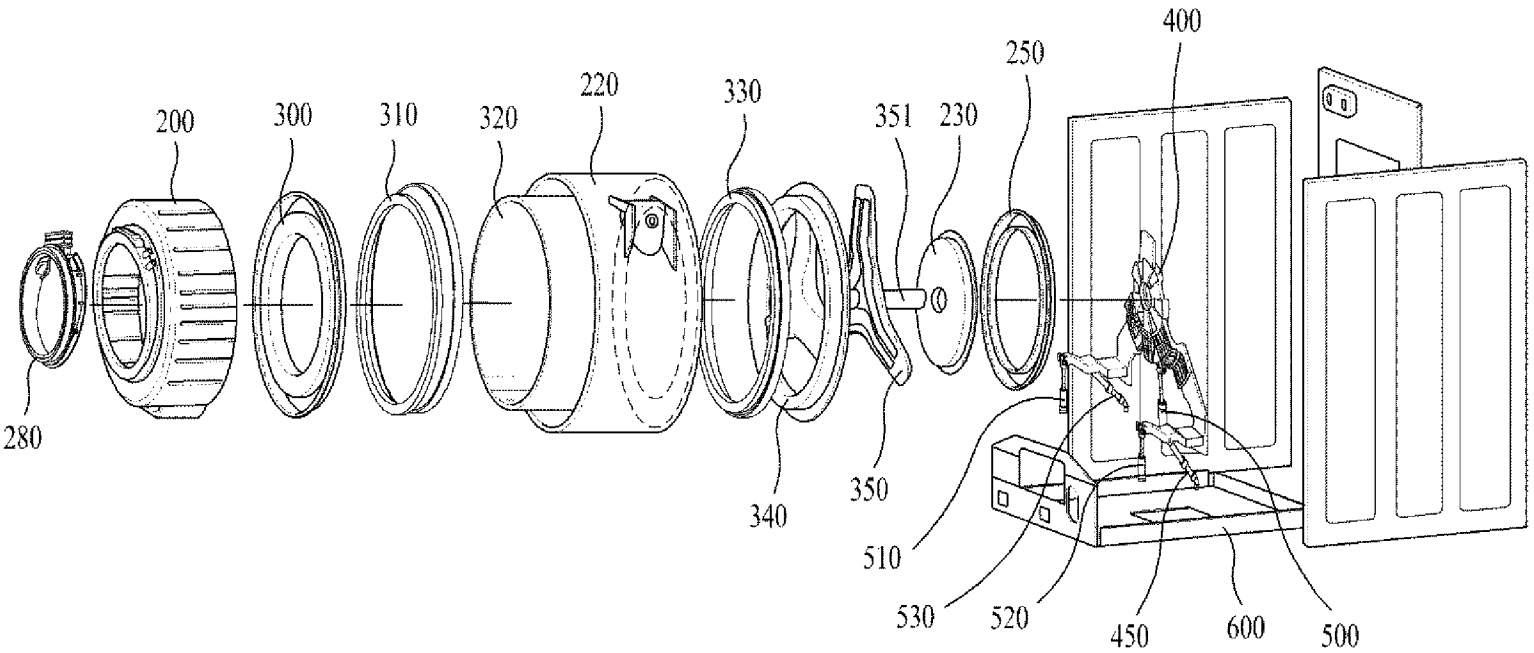
FIG. 1 illustrates an exploded perspective view of a laundry machine in accordance with a preferred embodiment of the present invention.

FIG. 1 is a partial exploded perspective view illustrating a laundry machine according to one embodiment of the present invention.

According to a laundry machine according to an embodiment, the tub may be fixedly supported to the cabinet or it may be supplied to the cabinet by a flexible supporting structure such as a suspension unit which will be described later. Also, the supporting of the tub may be between the supporting of the suspension unit and the completely fixed supporting.

That is, the tub may be flexibly supported by the suspension unit which will be described later or it may be complete-fixedly supported to be movable more rigidly. Although not shown in the drawings, the cabinet may not be provided unlike embodiments which will be described later. For example, in case of a built-in type laundry machine, a predetermined space in which the built-in type laundry machine will be installed may be formed by a wall structure and the like, instead of the cabinet. In other words, the built-in type laundry machine may not include a cabinet configured to define an exterior appearance thereof independently.

The laundry machine according to this embodiment of the present invention includes a tub fixedly supported to a cabinet. The tub includes a tub front 200 configured to define a front part thereof and a tub rear 220 configured to define a rear part thereof. The tub front 200 and the tub rear 220 are assembled to each other by screws and a predetermined space is formed in the assembled structure to accommodate a drum. The tub rear 220 may include an opening formed in a rear surface thereof and an inner circumference of the rear surface of the tub rear 220 is connected with an outer circumference of a rear gasket 250. An inner circumference of the rear gasket 250 is connected with a tub back 230. The tub back 230 includes a through-hole formed in a center thereof and a shaft passes the through-hole. The rear gasket 250 may be made of flexible material not to transmit the vibration of the tub back 230 to the tub rear 220.

The tub rear 220 includes a rear surface 128. The rear surface 128 of the tub rear 220, the tub back 230 and the rear gasket 250 define a rear wall of the tub. The rear gasket 250 is sealingly connected with the tub back 230 and the tub rear 220 and it prevents wash water held in the tub from leaking out. The tub back 230 is vibrated together with the drum during the rotation of the drum. At this time, the tub back 230 is spaced apart from the tub rear 220 at a predetermined distance enough not to interfere with the tub rear 220. Since the rear gasket 250 is made of a flexible material, it allows the tub back 230 to relative-move without interfering with the tub rear 220. The rear gasket 250 may include a corrugation part 252 extendible enough to allow such a relative movement of the tub back 230.

A foreign-substance-preventing member 280 is connected with a front portion of the tub front 200 to prevent foreign substances from coming between the tub and the drum. The foreign-substance-preventing member 280 is made of a flexible material and it is fixedly installed to the tub front 200. The foreign-substance-preventing member 280 may be made of the same material as that used to make the rear gasket 250 and it will be referenced to as front gasket for convenience sake.

The drum includes a drum front 300, a drum center 320 and a drum back 340. Balancers 310 and 330 are installed in front and rear portions of the drum, respectively. The drum back 340 is connected with a spider 350, and the spider 350 is connected with a rotational shaft 351. The drum 32 is rotated in the tub by the rotational force transmitted via the rotational shaft 351.

The rotational shaft 351 is directly connected with a motor by passing through the tub back 230. Specifically, the rotational shaft 351 is directly connected with a rotor of the motor. A bearing housing 400 is coupled to a rear surface of the tub back 230. The bearing housing 400 is located between the motor and the tub back 230 to rotatably support the rotational shaft 351.

A stator is fixedly installed to the bearing housing 400 and the rotor is located around the stator. As mentioned above, the rotor is directly connected with the rotational shaft 351. The motor is an outer rotor type motor and it is directly connected with the rotational shaft 351.

The bearing housing 400 is supported from a cabinet base 600 through a suspension unit. The suspension unit includes three perpendicular supporting suspensions and two oblique-supporting suspensions configured to support the bearing housing obliquely in a forward and rearward direction.

The suspension unit may include a first cylinder spring 520, a second cylinder spring 510, a third cylinder spring 500, a first cylinder damper, and a second cylinder damper 530, wherein the first cylinder damper, although not shown, is symmetrically installed to be opposite to the second cylinder damper.

The first cylinder spring 520 is connected between a first suspension bracket 450 and the cabinet base 600, and the second cylinder spring 510 is connected between a second suspension bracket 440 and the cabinet base 600.

The third cylinder spring 500 is directly connected between the bearing housing 400 and the cabinet base 600.

The first cylinder damper 540 is obliquely installed between the first suspension bracket 450 and a rear portion of the cabinet base. The second cylinder damper 530 is obliquely installed between the second suspension bracket 440 and the rear portion of the cabinet base.

The cylinder springs 520, 510 and 500 of the suspension unit may be connected to the cabinet base 600 flexibly enough to allow the drum to move in a forward-and-rearward direction and a rightward-and-leftward direction, not completely fixed to the cabinet base 600. That is, the cylinder springs 520, 510 and 500 elastically support the drum to allow the drum to rotate vertically and horizontally with respect to the connected point with the cabinet base.

The perpendicular ones of the suspensions suspend the vibration of the drum elastically and the oblique ones dampen the vibration. That is, out of the vibration system that includes springs and damping means, the perpendicularly installed ones are employed as springs and the obliquely installed ones are employed as damping means.

The tub front and the tub rear are fixedly secured to the cabinet and the vibration of the drum is suspendingly supported by the suspension unit. Substantially, the structure of the tub and the drum may be separate. Even when the drum is vibrated, the tub may not be vibrated structurally.

The bearing housing and the suspension brackets are connected by first and second weights 431 and 430.

Hereinafter, a balancer will be described in more detail.

First of all, if the drum is rotated in a state that laundry is placed in the drum, unbalance may be generated by the laundry. Since such unbalance may cause high vibration of the drum during a spinning cycle, it is preferably required to reduce such unbalance (UB). In particular, as the rotation speed of the drum is increased, it reaches a natural vibration region of the laundry machine. In this case, a problem may occur in that the vibration becomes great if unbalance is too great.

Since it is impossible to uniformly distribute the laundry inside the drum, it is important to reduce unbalance if possible. An allowable unbalance rate may be required for the laundry machine considering characteristics of the laundry machine. In this respect, it is required to sense unbalance and compare the sensed unbalance with allowable unbalance to control rotation of the drum.

In order to reduce unbalance, several solutions may be provided. One of the several solutions is laundry distribution or uniform laundry distribution for varying the position of the laundry inside the drum.

Also, in order to reduce unbalance, a fluid may be located in an opposite position of an unbalanced position of the laundry to compensate for unbalance of the laundry. In other words, a balancer may be used.

In this embodiment, a ball balancer is used as the balancer. The ball balancer is respectively used at the front and rear portions of the drum.

Figure 2:
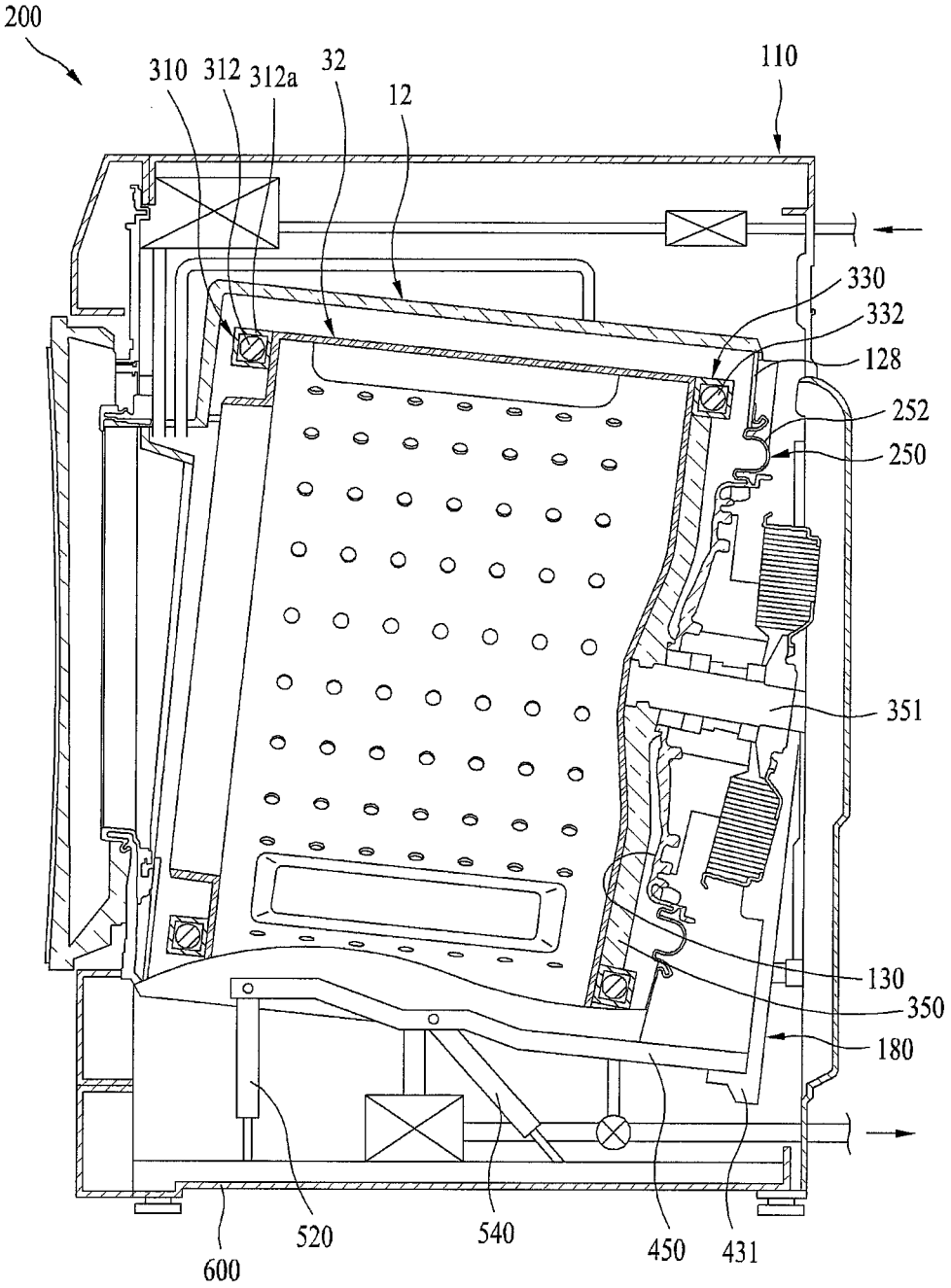
FIG. 2 illustrates a partial section of the laundry machine in FIG. 1.

In this embodiment, as shown in FIG. 2, the front ball balancer 310 is provided at the front portion of the drum, and the rear ball balancer 330 is provided at the rear portion of the drum. In more detail, the front ball balancer 310 is mounted on a front surface of the drum front 300, and the rear ball balancer 330 is mounted on a rear surface of the drum back 340. To this end, the drum front 300 may have a front recess recessed in a rearward direction on the front surface, and the drum back 340 may have a rear recess recessed in a forward direction.

In this embodiment, although not necessarily required, it is preferably required that the front ball balancer 310 is structurally the same as the rear ball balancer 330.

Figure 3:
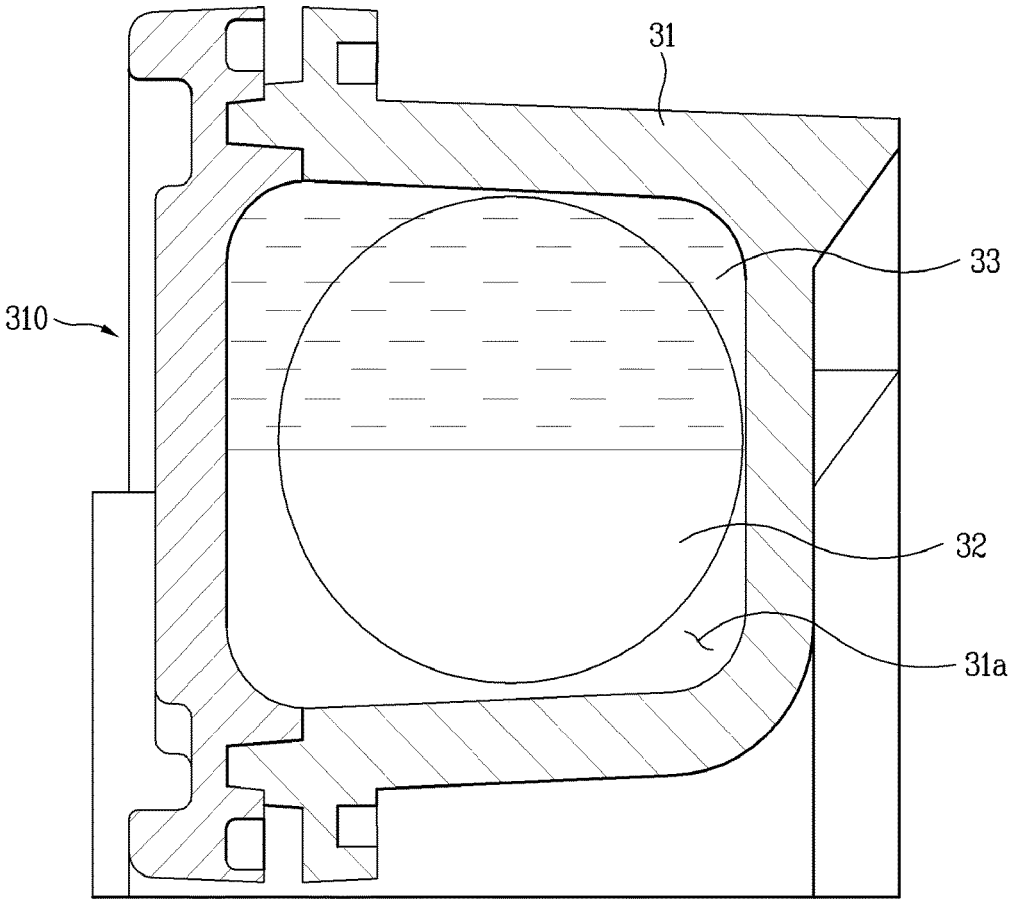
FIG. 3 illustrates a section of a front balancer.

FIG. 3 illustrates a sectional structure of the front ball balancer 310.

First of all, the front ball balancer 310 includes a race 31, a ball 32, and an oil 33. The race 31 may have a ring shaped ball space portion 31*a* where the ball 32 can move therein. The ball space portion 31*a* may have a square shape roughly as shown.

A plurality of balls 32 are received in the ball space portion 31*a*. The number of balls received in the ball space portion 31*a* and a diameter of the ball are defined considering the unbalance rate, together with vibration characteristics of the laundry machine.

Also, since the ball space portion 31*a* is filled with the oil 33, the number and diameter of balls received in the ball space portion 31*a* are preferably defined considering the amount and viscosity of the oil 33, which affect movement of the ball 32. The amount and viscosity of the oil 33 may be determined such that the ball 32 of the ball balancer may have required movement. Also, the amount and viscosity of the oil 33 may be determined considering vibration characteristics of the laundry machine.

In this embodiment, 14 balls 32 are received in the ball space portion 31*a*, and each of the balls has a diameter of 18.55 mm to 19.55 mm, preferably 19.05 mm. The ball space portion 31*a* of the race has a sectional area in the range of 410 mm2 to 413 mm2, preferably 412 mm2. A center diameter of the sectional area of the ball space portion 31*a* is in the range of 500 mm to 510 mm, preferably 505 mm. Silicon based oil such as Poly Dimethylsiloxane (PDMS) is used as the oil 33. Preferably, the oil 33 has viscosity of 300 cs at a room temperature, and has a filling level of 340 cc to 360 cc, preferably 350 cc. It is to be understood that the present invention is not limited to the aforementioned characteristic values of the ball balancer.

Hereinafter, a method of using movement of the ball inside the ball balancer when the drum is rotated with unbalance will be described. Since the ball balancer is mounted on the drum and then rotated together with the drum, movement of the ball inside the ball balancer can be controlled finally by rotation control of the drum.

In particular, if the rotation speed of the drum is close to natural vibration of the laundry machine, the vibration of the drum may occur seriously. In this case, it is important how the ball is controlled.

In the laundry machine according to the related art, a natural vibration mode occurs in the range of 200 rpm to 270 rpm. Such a period where the natural vibration mode occurs may be referred to as a transient region. In this transient region, a plurality of natural vibration modes may exist. If the drum should be rotated at a rotation speed more than the transient region, it is important to control the ball such that the vibration of the drum becomes low.

Generally, the transient region may be defined as a rotation speed range of the drum. As described above, the transient region may be defined as a region that includes natural vibration. In the vibration system, natural vibration is determined by mass and rigidity (for example, spring constant). Since mass may be varied depending on the amount of laundry in the laundry machine, the transient region is preferably controlled considering mass.

Figure 4:
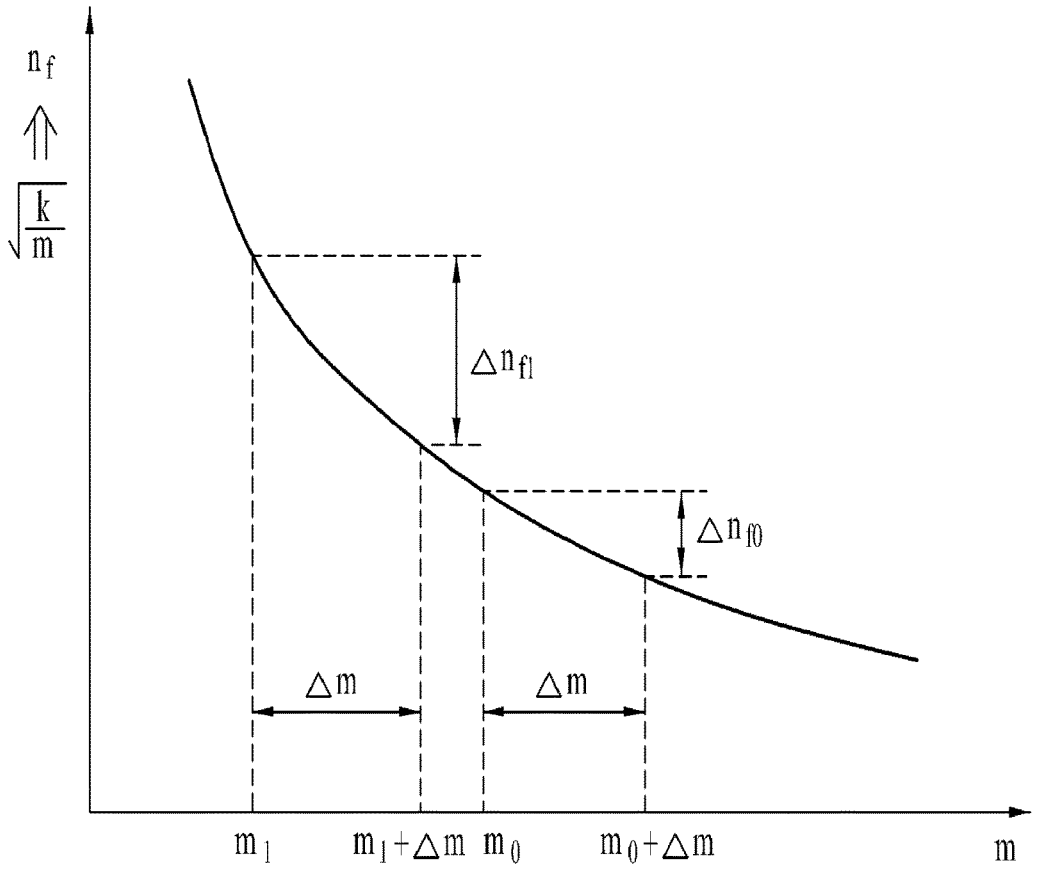
FIG. 4 illustrates a graph showing a relation of mass vs. a natural frequency.

FIG. 4 illustrates a graph showing a relation of mass vs. a natural frequency. It is assumed that, in vibration systems of two laundry machines, the two laundry machines have mass of m0 and m1 respectively and maximum holding laundry amounts are Δm, respectively. Then, the transition regions of the two laundry machines can be determined taking Δnf0 and Δnf1 into account, respectively. In this instance, amounts of water contained in the laundry will not be taken into account, for the time being.

In the meantime, referring to FIG. 4, the laundry machine with smaller mass ml has a range of the transient region greater than the laundry machine with greater mass m0. That is, the range of the transient region having variation of the laundry amount taken into account becomes the greater as the mass of the vibration system becomes the smaller.

The ranges of the transient regions will be reviewed on the related art laundry machine and the laundry machine of the embodiment.

The related art laundry machine has a structure in which vibration is transmitted from the drum to the tub as it is, causing the tub to vibrate. Therefore, in taking the vibration of the related art laundry machine into account, the tub is indispensible. However, in general, the tub has, not only a weight of its own, but also substantial weights at a front, a rear or a circumferential surface thereof for balancing. Accordingly, the related art laundry machine has great mass of the vibration system.

Opposite to this, in the laundry machine of the embodiment, since the tub, not only has no weight, but also is separated from the drum in view of a supporting structure, the tub may not be put into account in consideration of the vibration of the drum. Therefore, the laundry machine of the embodiment may have relatively small mass of the vibration system.

Then, referring to FIG. 4, the related art laundry machine has mass m0 and the laundry machine of the embodiment has mass ml, leading the laundry machine of the embodiment to have a greater transient region, at the end.

Moreover, if the amounts of water contained in the laundry are taken into account simply, Δm in FIG. 4 will become greater, making a range difference of the transient regions even greater. And, since, in the related art laundry machine, the water drops into the tub from the drum even if the water escapes from the laundry as the drum rotates, an amount of water mass reduction come from the spinning is small. Since the laundry machine of the embodiment has the tub and the drum separated from each other in view of vibration, the water escaped from the drum influences the vibration of the drum, instantly. That is, the influence of a mass change of the water in the laundry is greater in the laundry machine of the embodiment than the related art laundry machine.

Under above reason, though the related art laundry machine has the transient region of about 200~270 rpm, A start RPM of the transient region of the laundry machine according to this embodiment may be similar to a start RPM of the transient region of the conventional laundry machine. An end RPM of the transient region of the laundry machine according to this embodiment may increase more than a RPM calculated by adding a value of approximately 30% of the start RPM to the start RPM. For example, the transient region finishes at an RPM calculated by adding a value of approximately 80% of the start RPM to the start RPM. According to this embodiment, the transient region may include a RPM band of approximately 200 to 350 rpm.

In the meantime, by reducing intensity of the vibration of the drum, unbalance may be reduced. For this, even laundry spreading is performed for spreading the laundry in the drum as far as possible before the rotation speed of the drum enters into the transient region.

In a case, a balancer is used, a method may be put into account, in which the rotation speed of the drum passes through the transient region while movable bodies provided in the balancer are positioned on an opposite side of an unbalance of the laundry. In this instance, it is preferable that the movable bodies are positioned at exact opposite of the unbalance in middle of the transient region.

However, as described above, the transient region of the laundry machine according to this embodiment is relatively wide in comparison to that of the conventional laundry machine. Because of that, even if the laundry even-spreading step or ball balancing is implemented in a RPM band lower than the transient region, the laundry might be in disorder or balancing might be failed with the drum speed passing the transient region.

As a result, balancing may be implemented at least one time in the laundry machine according to this embodiment before and while the drum speed passing the transient region. Here, the balancing may be defined as rotation of the drum at a constant-speed for a predetermined time period. Such the balancing allows the movable body of the balancer to the opposite positions of the laundry, only to reduce the unbalance amount. By extension, the effect of the laundry even-spreading. Eventually, the balancing is implemented while the drum speed passing the transient region and the noise and vibration generated by the expansion of the transient region may be prevented.

Here, when the balancing is implemented before the drum speed passing the transient region, the balancing may be implemented in a different RPM band from the RPM of the conventional laundry machine. For example, if the transient region starts at 200 RPM, the balancing is implemented in the RPM band lower than approximately 150 RPM. Since the conventional laundry machine has a relatively less wide transient region, it is not so difficult for the drum speed to pass the transient region even with the balancing implemented at the RPM lower than approximately 150 RPM. However, the laundry machine according to this embodiment has the relatively wide expanded transient region as described above. if the balancing is implemented at the such the low RPM like in the conventional laundry machine, the positions of the movable bodies might be in disorder by the balancing implemented with the drum speed passing the transient region. Because of that, the laundry machine according to this embodiment may increase the balancing RPM in comparison to the conventional balancing RPM, when the balancing is implemented before the drum speed enters the transient region. That is, if the start RPM of the transient region is determined, the balancing is implemented in a RPM band higher than a RPM calculated by subtracting a value of approximately 25% of the start RPM from the start RPM. For example, the start RPM of the transient region is approximately 200 RPM, the balancing may be implemented in a RPM band higher than 150 RPm lower than 200 RPM.

Moreover, the unbalance amount may be measured during the balancing. That is, the control method may further include a step to measure the unbalance amount during the balancing and to compare the measured unbalance amount with an allowable unbalance amount allowing the acceleration of the drum speed. If the measured unbalance amount is less than the allowable unbalance amount, the drum speed is accelerated after the balancing to be out of the transient region. In contrast, if the measured unbalance amount is the allowable unbalance amount or more, the laundry even-spreading step may be re-implemented. in this case, the allowable unbalance amount may be different from an allowable unbalance amount allowing the initial accelerating.

A relation of the positions of the balls and the position of the unbalance may be defined as an angle of a center of centrifugal force of the balls (hereafter, a centrifugal force center angle) with respect to a center of the centrifugal force of the unbalance. Or, the relation of the positions of the balls and the position of the unbalance may be defined as an angle (hereafter, a closet ball angle) of a closest ball from the unbalance with respect to the center of the centrifugal force of the unbalance.

Figure 5:
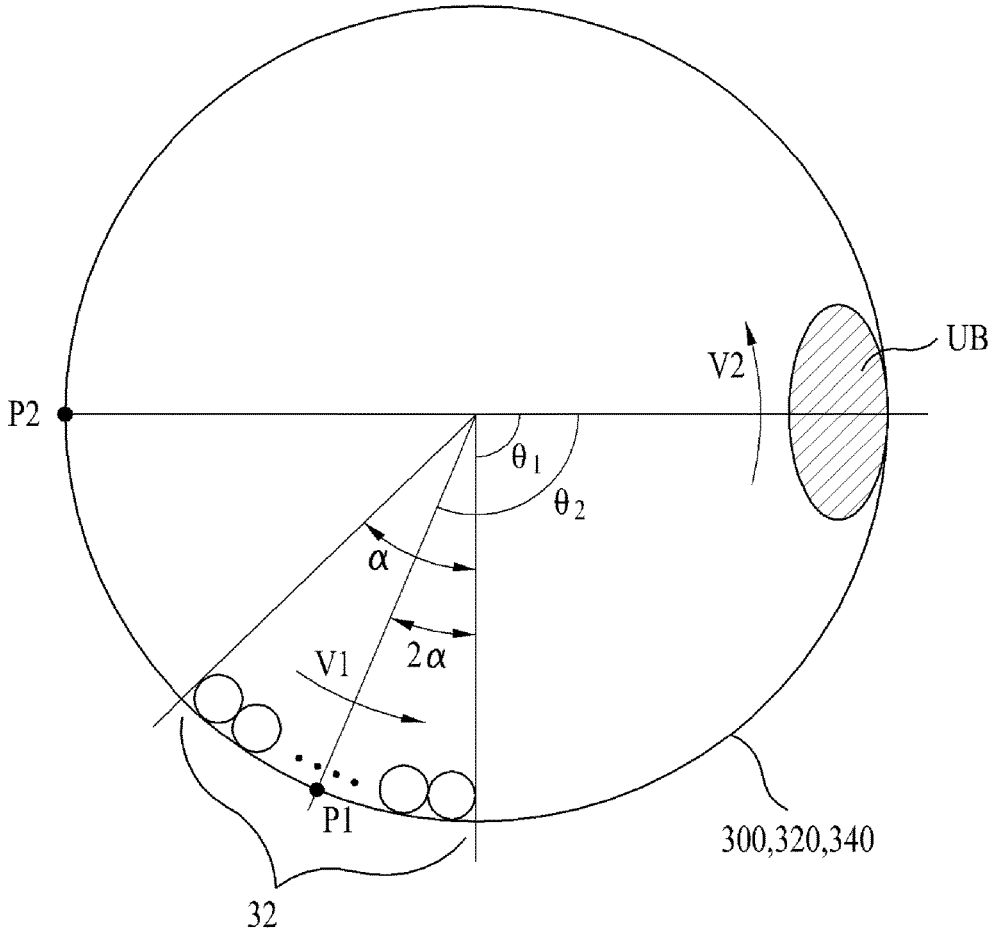
FIG. 5 illustrates a schematic view of a relation of an unbalance versus positions of balls as the drum rotates.

FIG. 5 illustrates a schematic view of a relation of unbalance UB versus ball positions as the drum rotates. In FIG. 5, of the relation of unbalance UB versus ball positions, the closest ball angle is θ1 and the centrifugal force center angle is θ2. For convenience's sake, a ball unbalance angle denotes θ1 or θ2.

The ball may be formed of steel, and if all of the balls are in contact with one another on a line, the centrifugal force center will be P1 shown in FIG. 5.

As the drum rotates, the balls rotate by friction with the drum. Since movement of the balls are not confined by the drum, the balls rotate at a speed different from the rotation speed of the drum. However, the unbalance, which is the laundry stuck to an inside of the drum, can rotate at a speed almost the same with the rotation speed of the drum owing to adequate friction and the lifts on the inside wall of the drum. Therefore, the rotation speed of the unbalance is different from the rotation speed of the balls. Since the balls rotate by rotation of the drum, the rotation speed of the unbalance is faster than the rotation speed of the balls. More specifically, an angular velocity is faster.

If the rotation speed of the drum becomes faster gradually, the balls come into close contact with an outside circumferential surface of a ball housing portion of a racer, by the centrifugal force. And, if the centrifugal force becomes greater, making friction between the circumferential surface and the balls to be greater than a certain value, the balls rotate at a rotation speed the same with the drum. In this case, the balls have fixed positions with respect to the drum the same as the unbalance. In the specification, for convenience's sake, a case when the balls rotate while the balls have the fixed positions with respect to the drum will be expressed as 'balancing position' or 'balancing is done'.

A lowest rotation speed of the balancing speed can vary with the ball balancers, and with cases whether the ball balancer is mounted vertically, or horizontally. If the ball balancer is mounted vertically, contact of the balls with the outside circumferential surface of the ball housing portion of the racer can vary with positions due to gravity. If a constant rotation speed can be kept at a certain rotation speed at which the balancing can be made for a certain time period, the balls can be set at positions opposite to a position of the unbalance exactly, i.e., the P2 position in FIG. 5.

In the meantime, the balancing may fail at a rotation speed lower than the transient region due to low centrifugal force. Therefore, when it is intended to pass the transient region, rather than passing through the transient region after making the balancing, it is possible to position the balls on an opposite side of the unbalance during the rotation speed of the drum passes through the transient region by making the positions of the balls known while making the drum to rotate at a constant speed. That is, even if the balancing can not be made, it is possible that the rotation speed passes through the transient region while the balls are positioned on the opposite side of the unbalance. For an example, referring to FIG. 5, it is possible that the rotation speed passes through the transient region while the angle θ1 or θ2 between the balls and the unbalance is 90° or greater than 90°. In this instance, it will be more preferable if the angle is 180° at middle of the transient region.

In the meantime, if the range of the transient region is wide such that the angle between the balls and the unbalance becomes less than 90° in a state the rotation speed does not pass the transient region yet, the vibration will become more intense as mass of the balls is added to the unbalance.

It is preferable that the angle between the balls and the unbalance is close to 180° for reducing the vibration even if the angle between the balls and the unbalance is not less than 90°.

Therefore, in a case the range of the transient region is wide like the laundry machine of the embodiment, it may not be preferable to pass the transient region with one time of acceleration.

A method for controlling a laundry machine to pass the transient region for performing spinning will be described by using a graph showing a relation of a time versus a rotation speed with reference to FIG. 6.

Figure 6:
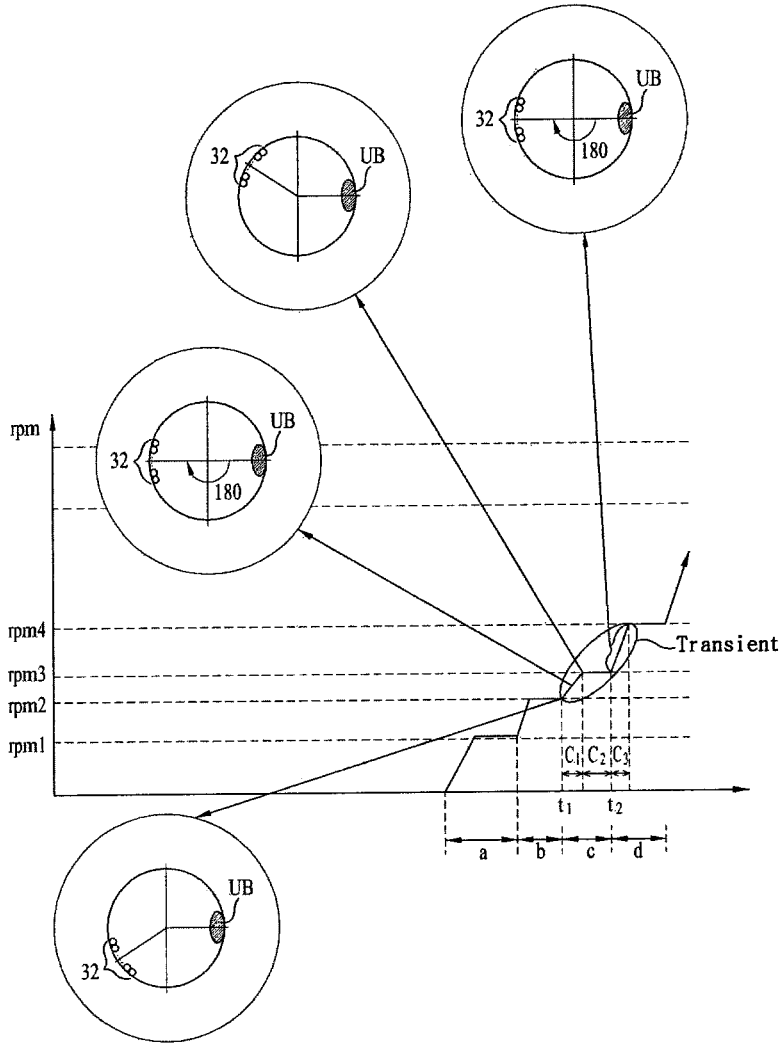
FIG. 6 illustrates a schematic view of a spinning method in accordance with a preferred embodiment of the present invention.

In FIG. 6, an a section denotes a first constant speed rotation step, a b section denotes a second constant speed rotation step, a c1 section denotes a first transient region step, a c2 section denotes a second transient region step, and a c3 section denotes a third transient region step.

In the a section, laundry spreading or laundry disentangling is performed, and a first unbalance is sensed while the drum makes constant speed rotation at the first rotation speed and the first unbalance is compared to a first allowable unbalance.

If the first unbalance sensed thus is below the first allowable unbalance, the drum is accelerated up to a second rotation speed and kept rotated at the second rotation speed (b section). In the b section, a second unbalance is sensed and compared to a second allowable balance. If the second unbalance sensed thus is below a second allowable unbalance, a preparation is made for passing the c section which is a transient region.

First, in order to pass the c1 section, positions of the balls are made known while rotating the drum at a constant speed, to determine an acceleration time point t1. In the c1 section, the t1 and an acceleration slope can be determined such that the angle between the unbalance and the balls are 90° or greater than 90°. In this instance, the t1 and the acceleration slope can be determined such that the angle between the unbalance and the balls is 180° at middle of the cl section.

If the rotation speed of the drum passes through the c1 section and reaches to the third rotation speed, the drum is kept rotating at a constant speed for a preset time period (c2 section). In the c1 section, the angle between the unbalance and the balls passes the 180° such that the unbalance and the balls come closer gradually, again. Therefore, in the c2 section, while rotating in a constant speed, a preparation is made for passing through the c3 section which is a remained transient region.

The c2 section is a section in which the angle between the unbalance and the balls is made to increase again such that the rotation speed of the drum passes the c3 section in a state the angle between the unbalance and the balls is greater 90°, again.

In the c2 section, the angle between the unbalance and the balls can be smaller than 90°. However, as the constant speed is kept, the angle can be increased greater than 90°, again. In a state the angle between the unbalance and the balls is greater than 90°, the rotation speed of the drum is made to pass through the c3 section.

In this instance, the balancing can be made in the c2 section. That is, it is possible to maintain a state in which the angle between the unbalance and the balls to be 180° . For this, it is required to maintain the c2 section until the balancing is done. If it is intended not to make the balancing in the c2 section, it is preferable that a section is included to middle of the c2 section in which the angle between the unbalance and the balls is 180°.

If the balancing is done in the c2 section thus, since the vibration of the drum can become smaller further, it is preferable to make the balancing in the c2 section.

And, since there can be almost no change of the positions of the balls once the balancing is done in the c2 section thus, there can be nothing unnatural in passing the transition region even if the c3 section is wide. Therefore, the c3 section can have a range of the rotation speed greater than the c1 section. In other words, an inclination of rotation speed of C3 may be larger than that of C1

Moreover, since the positions of the balls are not required to be taken into account once the balancing is done in the c2 section, the rotation speed of the drum can pass the c3 section, quickly. Accordingly, the c3 section can have the acceleration slope steeper than the c1 section.

Since the balls are moving in the c1 section, if the rotation speed is increased too quickly, the vibration can become unstable.

In the meantime, it is preferable that the third rotation speed is determined such that the c1 section transits to the c2 section while vibration perpendicular to the rotation shaft of the drum becomes smaller, gradually.

Since the angle between the unbalance and the balls can even be less than 90° in c2 section, it is preferable the transition is performed in a state the vibration of the drum becomes small, adequately.

Accordingly, it is preferable that an average of intensity of the vibration of the drum in the c2 section is below maximum intensity of the vibration in the c1 section.

In the meantime, in determining the c2 section, it is preferable that the intensity of the vibration of the drum in the c3 section is smaller than the intensity of the vibration of the drum in the c1 section. Since the c3 section has the rotation speed higher than the c1 section, it is preferable that the c3 section has the intensity of the vibration of the drum smaller than the intensity of the vibration of the drum in the c1 section. It is preferable that maximum intensity of the vibration of the drum in the c3 section is below an half of the maximum intensity of the vibration of the drum in the c1 section.

Even though the embodiment takes performance of the spinning as an example, besides the spinning, the embodiment can also be applied to a case, if any, in which the drum is rotated exceeding the transition region.

Figure 7:
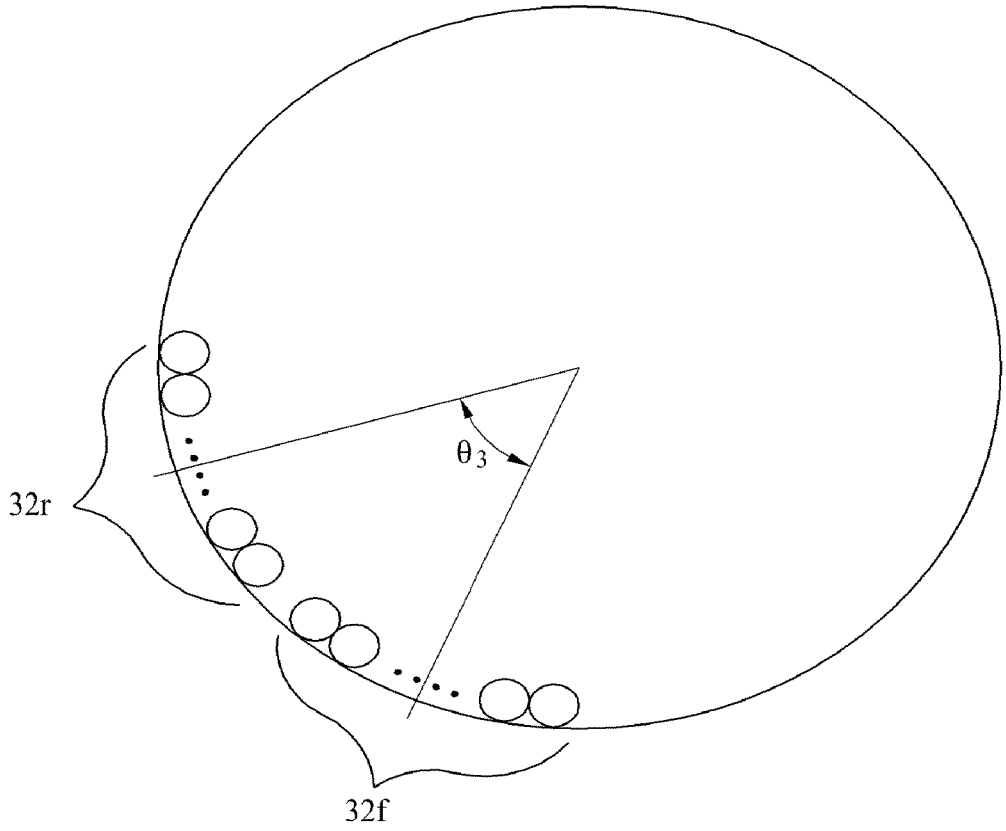
FIG. 7 is a diagram illustrating the position relation between balls and unbalance based on rotation of a drum.

As shown in FIG. 5, when the drum is rotated at a constant speed more than the transient region as above, the vibration of the drum may occur such that displacement at the front portion of the drum is equal to that at the rear portion of the drum. Accordingly, as shown in FIG. 7, an angle θ3 between the front balls 32*f* and the rear balls 32*e* may be within 90°. FIG. 7 is a diagram illustrating the position relation between the front balls 32*f* and the rear balls 32*e* when viewed through the drum in a forward direction.

At the transient region, a vibration mode where front displacement of the vibration of the drum is different from rear displacement thereof may occur. For example, a vibration mode where front displacement of the vibration of the drum is opposite to rear displacement thereof may occur. For convenience' sake, this vibration mode will be referred to as a diagonal vibration mode. Meanwhile, the transient region of the laundry machine of this embodiment may expand compared to the conventional laundry machine. Therefore, the vibration mode of the drum may be changed due to the expanded transient region, for example, the diagonal vibration mode can be generated. In this diagonal vibration mode, if the rear balls 32*f* and the rear balls 32*e* are maintained at an angle within the range of 90° as described above, unbalance to the diagonal vibration mode may not be compensated normally, whereby the vibration of the drum may become severe.

The aforementioned diagonal vibration mode may start to occur as the vibration of the drum becomes close to natural vibration of the natural vibration mode corresponding to the diagonal vibration mode.

Accordingly, in order to reduce the vibration of the drum, the positions of the front balls 32*f* and the rear balls 32*e* should be corrected before the vibration of the drum reaches the natural vibration of the diagonal vibration mode.

To this end, before the vibration of the drum reaches the natural vibration, the drum is preferably subjected to constant speed rotation for a predetermined time at a rotation speed where the diagonal vibration mode occurs, whereby the positions of the front balls 32*f* and the rear balls 32*e* are corrected to compensate for unbalance.

In particular, the aforementioned laundry machine of this embodiment has a different structure from that of the related art. Since the natural vibration mode corresponding to the diagonal vibration mode may occur at the transient region, it is preferably required to correct the positions of the balls as described above.

Hereinafter, a control method for passing through the transient region to carry out a spinning cycle in the aforementioned laundry machine will be described using a rotation speed graph of the drum based on the passage of time with reference to FIG. 8.

Figure 8:
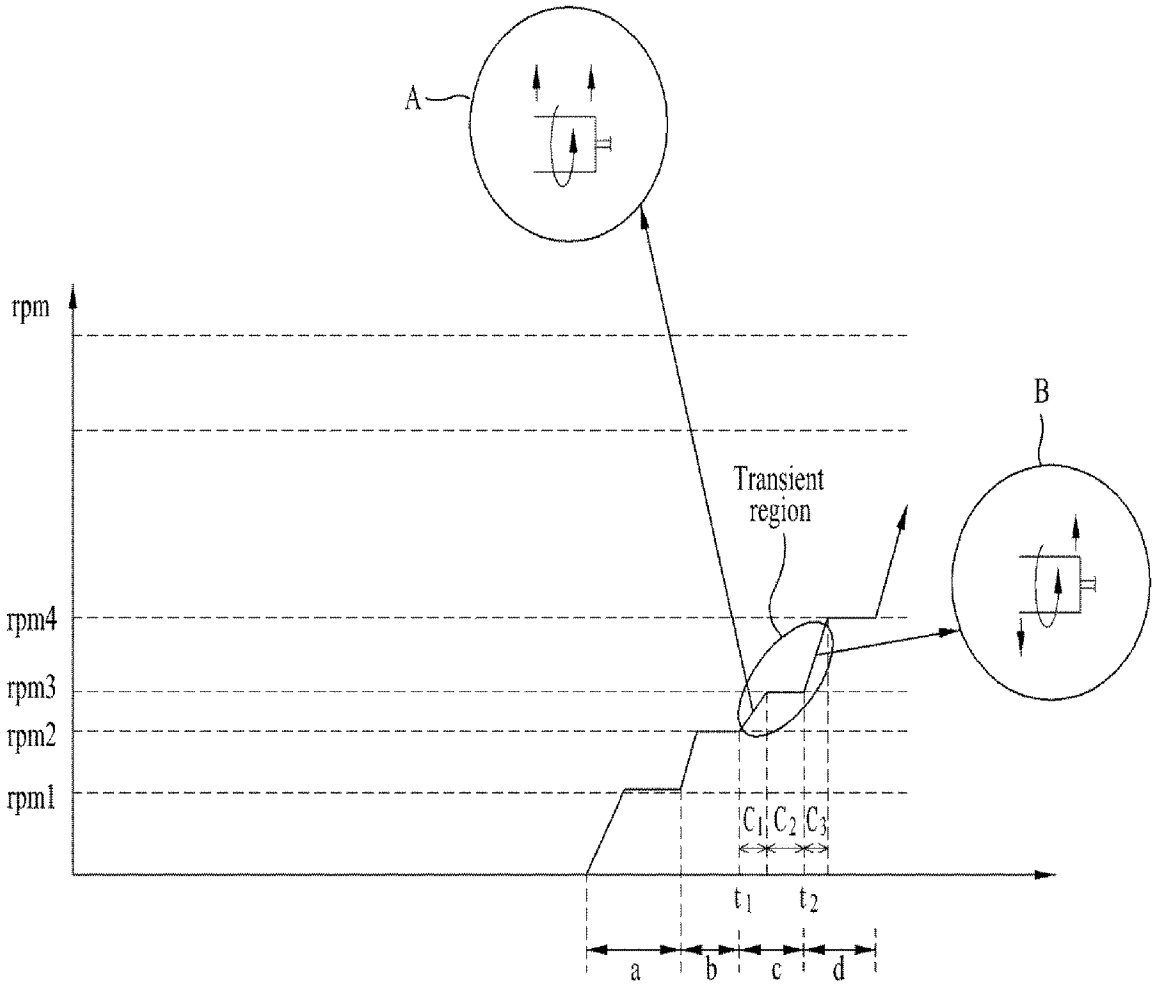
FIG. 8 is a diagram illustrating a spinning method according to one embodiment of the present invention.

In FIG. 8, period 'a' denotes a first constant speed rotation step, period 'b' a second constant speed rotation step, period 'c1' a first transient region step, period 'c2' third constant speed rotation step, period 'c3' a second transient region step, and period 'd' fourth constant speed rotation step.

First of all, at the period 'a', laundry distribution or laundry disentangling is carried out, and a first unbalance value is sensed while the drum is rotated at a constant speed of a first rotation speed, and then the sensed first unbalance value is compared with a first allowable unbalance value.

At this time, if the sensed first unbalance value is less than the first allowable unbalance value, the drum is accelerated to reach a second rotation speed and then rotated at a constant speed (period 'b'). At the period 'b', a second unbalance value is sensed and then the sensed second unbalance value is compared with a second allowable unbalance value. If the sensed second unbalance value is less than the second allowable unbalance value, the drum is subjected to warming-up for passing through the transient region period 'c'.

In this case, as shown in A of FIG. 8, at the first transient region period 'c1', the natural vibration mode where vibration displacement at the front portion of the drum is equal to that at the rear portion of the drum occurs. As shown in B of FIG. 8, at the second transient region period 'c3', the natural vibration mode corresponding to the diagonal vibration mode where vibration displacement at the front portion of the drum is contrary to that at the rear portion of the drum occurs.

First of all, in order to pass through the period 'c1', the drum is rotated at a constant speed at the period 'b' to check the position of the ball, whereby an acceleration timing t1 is determined. At the period 'c1', t1 and its acceleration inclination are determined such that the angle between the unbalance and the ball is in the range of 90° or more. At this time, in the middle of the period 'c1', t1 and its acceleration inclination can be determined such that the angle between the unbalance and the ball is in the range of 180°. At the period 'c1', the centrifugal force center of the front balls 32*f* and the centrifugal force center of the rear balls 32*e* can define an angle within the range of 90° based on the rotation center of the drum when viewed in a forward direction. Preferably, the front balls 32*f* and the rear balls 32*e* are located within the range of 90° to reduce the vibration of the vibration mode where displacement at the front portion of the drum and displacement at the rear portion of the drum are equal to each other in a perpendicular direction with respect to the rotational shaft.

If the rotation speed of the drum reaches the third rotation speed via the period 'c1', the drum is rotated at a constant speed for a predetermined time (period 'c2'). The period 'c2' may be regarded as a warming-up period for passing through the natural vibration mode corresponding to diagonal vibration that may occur at the period 'c3'.

At the period 'c2', the drum may be vibrated in the diagonal vibration mode as it is rotated at a rotation speed near the natural vibration of the natural vibration mode corresponding to the diagonal vibration. At this time, as the drum is rotated at a constant speed for a predetermined time, the position of the balls of the front ball balancer and the rear ball balancer is varied depending on the corresponding vibration mode.

After passing through the period 'c2', the rotation speed of the drum passes through the transient region at the period 'c3' in a state that the angle between the front balls 32*f* and the front unbalance and the angle between the rear balls 32*e* and the rear unbalance are 90° or more, respectively. At this time, when viewed from the drum in a forward direction, the angle between the front balls 32*f* and the rear balls 32*e* may be 90° or more. In order to reduce vibration of the diagonal vibration mode, it is preferable that the angle between the front balls 32*f* and the rear balls 32*e* is 90° or more.

The third rotation speed and the predetermined time can be determined considering that the front ball balancer and the rear ball balancer are subjected to balancing. In other words, as the drum is rotated at the third rotation speed for the predetermined time, the third rotation speed and the predetermined time can be determined in such a manner that the front balls 32*f* and the rear balls 32*e* are moved to a position for compensating front unbalance and a position for compensating rear unbalance, respectively, at angles of 180°, respectively, and then are maintained at their positions, respectively.

In this embodiment, the third rotation speed is preferably set in the range of 250 rpm to 290 rpm. If the rotation speed of the drum is too low, a vibration level of the diagonal vibration mode becomes weak, whereby the period 'c2' becomes longer or balancing may not be carried out preferably. Also, if the rotation speed of the drum is too high, severe vibration occurs and movement of the balls becomes unstable, whereby the positions of the balls may not be varied normally. Preferably, the third rotation speed of the drum is set in the range of 270 rpm. The period 'c2' is preferably maintained for 30 seconds, approximately.

The rotations speed of the drum strays from the transient region while it is passing through the period 'c3' where the natural vibration mode corresponding to diagonal vibration occurs. Afterwards, the rotation speed of the drum enters the period for rotating the drum at high speed to carry out the spinning cycle. At this time, it is necessary to vary the positions of the balls before the rotation speed of the drum enters the main spinning step.

At the period 'c2', since the front balls and the rear balls are located to be suitable for compensating the unbalance to diagonal vibration, they may not be suitable for the main spinning step having a vibration mode different from the diagonal vibration mode.

Accordingly, the period 'd' for realigning the positions of the balls while the rotation speed of the drum is maintained at a constant speed rotation of a fourth rotation speed after passing through the transient region will be required. In other words, it is preferably required to realign the balls to be suitable for compensating the unbalance to the vibration mode of the main spinning step.

As the balls are moved at the main spinning step, unbalance may occur severely. Accordingly, balancing is preferably carried out at the period 'd'. In other words, the rotation speed of the drum is preferably maintained at the fourth rotation speed suitable for the corresponding vibration mode such that the balls are located to compensate for unbalance.

The fourth rotation speed is preferably determined at a rotation speed that does not allow the diagonal vibration mode if possible. For example, the fourth rotation speed is preferably determined at a rotation speed different from the natural vibration of the diagonal vibration mode as much as a predetermined rate, whereby the fourth rotation speed is not affected by the diagonal vibration mode.

At the period 'd', the rotation speed of the drum can maintained in the range of 370 rpm to 390 rpm for 50 seconds to 70 seconds, preferably 60 seconds.

In the mean time, it is preferable that the acceleration inclination at the period 'c1' is smaller than that at the period 'c3'. If the balancing is carried out at the third rotation speed, since the balls may little be moved, the rotation speed of the drum can quickly pass through the period 'c3'. However, the balls continue to move without being balanced at the period 'c1', and considering such a movement of the balls, the rotation speed for passing through the period 'c1' is determined.

Finally, after passing through the period 'd', the main spinning step is carried out at 1000 rpm or more to spin the laundry.

Although the spinning cycle is carried out for example in this embodiment, this embodiment may be applied to any other case where the drum is rotated at a speed more than the transient region.

Figure 9:
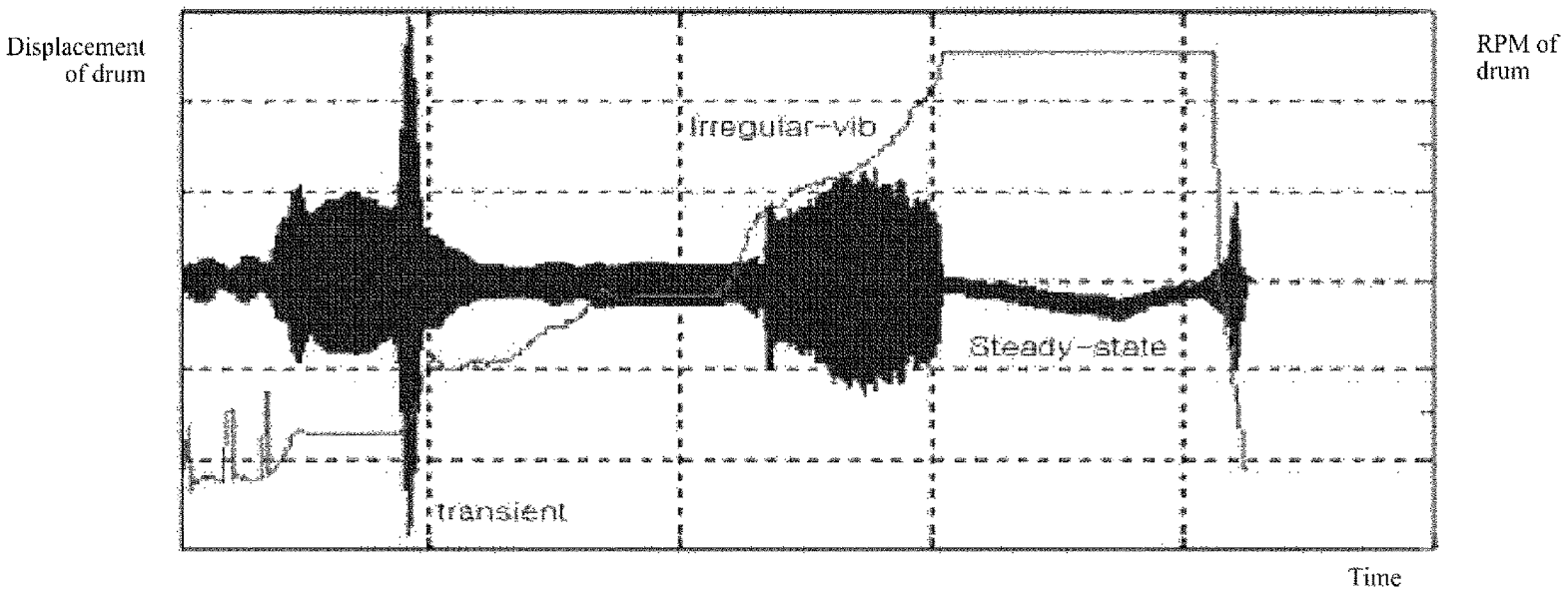
FIG. 9 is a graph illustrating vibration characteristics of the laundry machine.

First, vibration characteristics of the laundry machine according to the embodiment of the present invention will now be described with reference to FIG. 9.

As the rotation speed of the drum is increased, a region (hereinafter, referred to as "transient vibration region") where irregular transient vibration with high amplitude occurs is generated. The transient vibration region irregularly occurs with high amplitude before vibration is transited to a steady-state vibration region (hereinafter, referred to as "steady-state region"), and has vibration characteristics determined if a vibration system (laundry machine) is designed. Though the transient vibration region is different according to the type of the laundry machine, transient vibration occurs approximately in the range of 200 rpm to 270 rpm. It is regarded that transient vibration is caused by resonance. Accordingly, it is necessary to design the balancer by considering effective balancing at the transient vibration region.

In the mean time, as described above, in the laundry machine according to the embodiment of the present invention, the vibration source, i.e., the motor and the drum connected with the motor are connected with the tub 12 through the rear gasket 250. Accordingly, vibration occurring in the drum is little forwarded to the tub, and the drum is supported by a damping means and the suspension unit 180 via a bearing housing 400. As a result, the tub 12 can directly be fixed to a cabinet 110 without any damping means.

As a result of studies of the inventor of the present invention, vibration characteristics not observed generally have been found in the laundry machine according to the present invention. According to the general laundry machine, vibration (displacement) becomes steady after passing through the transient vibration region. However, in the laundry machine according to the embodiment of the present invention, a region (hereinafter, referred to as "irregular vibration") where vibration becomes steady after passing through the transient vibration region and again becomes great may be generated. For example, if the maximum drum displacement or more generated in an RPM band lower than the transient region or the maximum drum displacement or more of steady state step in a RPM band higher than the transient region is generated, it is determined that irregular vibration is generated. Alternatively, if an average drum displacement in the transient region, +20% to −20% of the average drum displacement in the transient region or ⅓or more of the maximum drum displacement in the natural frequency of the transient region are generated, it may be determined that the irregular vibration is generated.

However, as a result of the studies, irregular vibration has occurred in a RPM band higher than the transient region, for example has occurred at a region (hereinafter, referred to as "irregular vibration region") in the range of 350 rpm to 1000 rpm, approximately. Irregular vibration may be generated due to use of the balancer, the damping system, and the rear gasket. Accordingly, in this laundry machine, it is necessary to design the balancer by considering the irregular vibration region as well as the transient vibration region.

For example, the balancer is provide with a ball balancer, it is preferable that the structure of the balancer, i.e., the size of the ball, the number of balls, a shape of the race, viscosity of oil, and a filling level of oil are selected by considering the irregular vibration region as well as the transient vibration region. When considering the transient vibration region and/or the irregular vibration region, especially considering the irregular vibration region, the ball balancer has a greater diameter of 255.8 mm and a smaller diameter of 249.2. A space of the race, in which the ball is contained, has a sectional area of 411.93 mm2. The number of balls is 14 at the front and the rear, respectively, and the ball has a size of 19.05 mm. Silicon based oil such as Poly Dimethylsiloxane (PDMS) is used as the oil. Preferably, oil has viscosity of 300 CS at a room temperature, and has a filling level of 350 cc.

In addition to the structure of the balancer, in view of control, it is preferable that the irregular vibration region as well as the transient vibration region is considered. For example, to prevent the irregular vibration, if the irregular vibration region is determined, the balancing may be implemented at least one time before, while and after the drum speed passes the irregular vibration region. Here, if the rotation speed of the drum is relatively high, the balancing of the balancer may not be implemented properly and the balancing may be implemented with decreasing the rotation speed of the drum. however, if the rotation speed of the drum is decreased to be lower than the transient region to implement the balancing, it has to pass the transient region again. In decreasing the rotation speed of the drum to implement the balancing, the decreased rotation speed may be higher than the transient region.

A control method of the laundry machine according to the embodiment of the present invention will be described with reference to FIG. 10 to FIG. 12. When washing is carried out by the laundry machine, the washing course generally includes a washing cycle, a rinsing cycle, and a spinning cycle. In this embodiment, the spinning cycle that is likely to cause irregular vibration due to high speed rotation of the drum will mainly be described.

Figure 10:
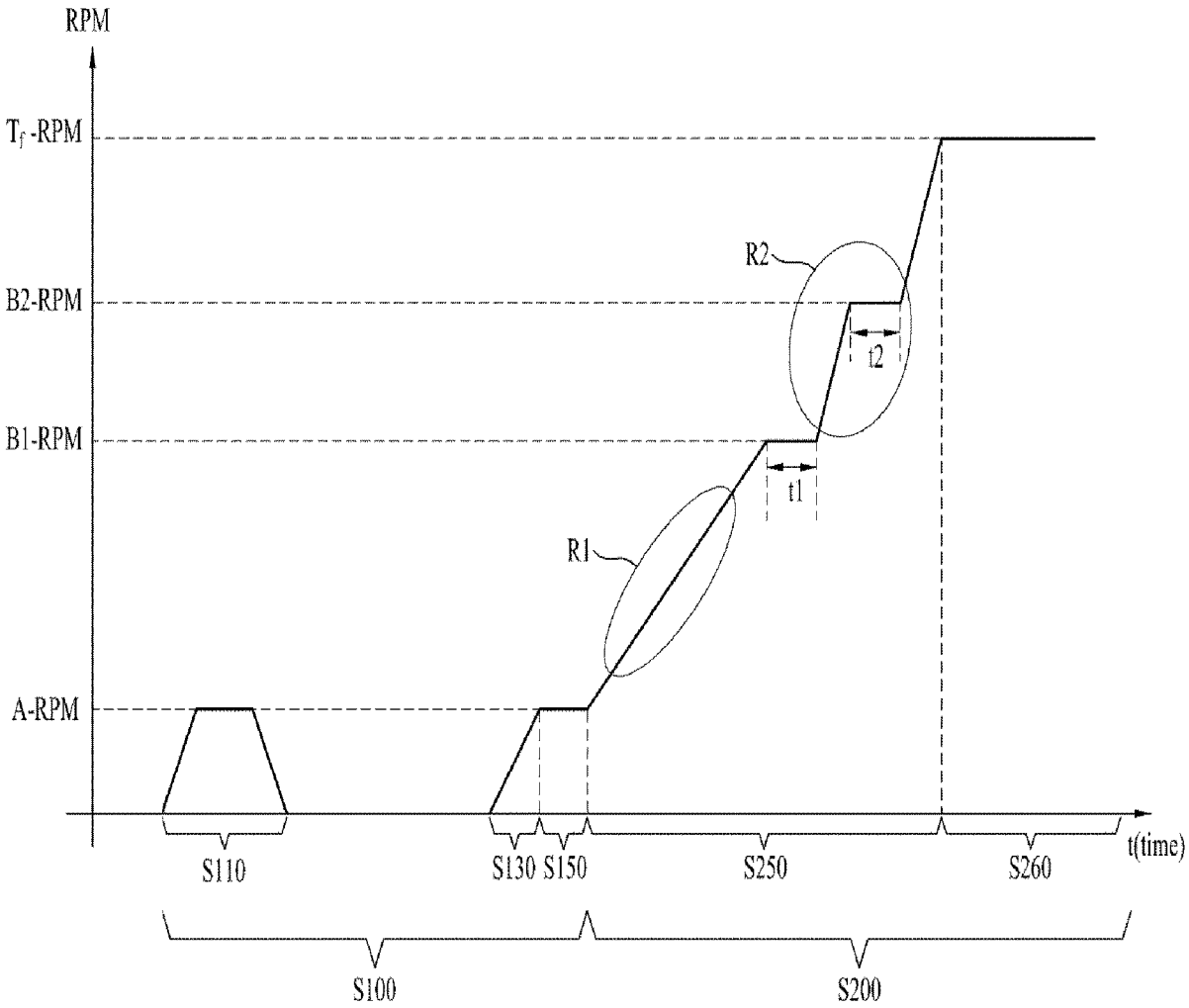
FIG. 10 is a graph illustrating an example of a control method of a laundry machine according to the present invention.
Figure 11:
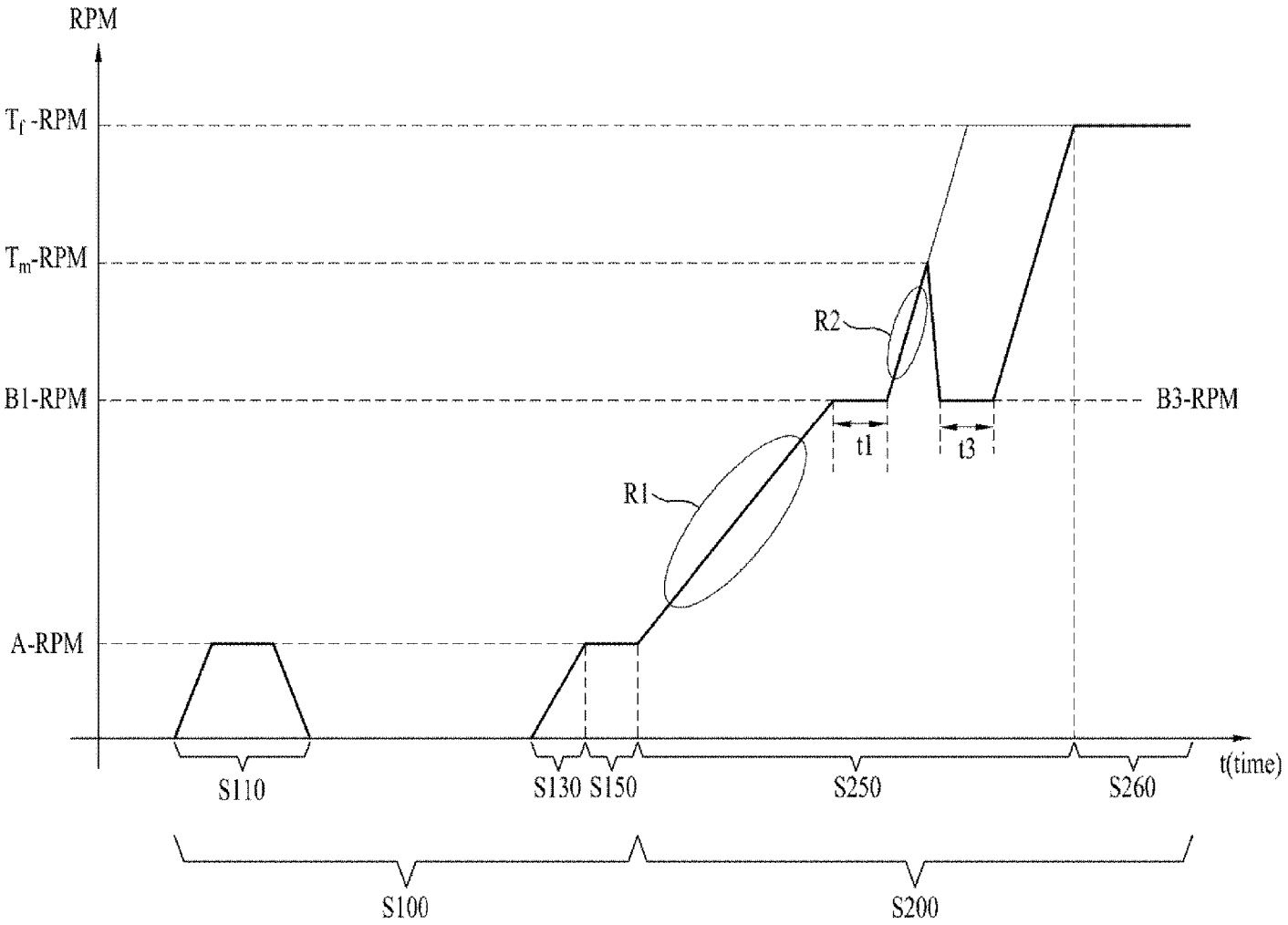
FIG. 11 is a graph illustrating another example of a control method of a laundry machine according to the present invention.

FIG. 10 is a graph illustrating an example of a control method of a laundry machine according to the present invention. The graph of FIG. 10 illustrates variation of the rotation speed of the drum based on the passage of time. In FIG. 10, a horizontal axis represents time, and a vertical axis represents a target rotation speed of the drum, i.e., revolutions per minute (RPM).

For reference, before a control method for reducing irregular vibration is described, the spinning cycle will be described. The spinning cycle includes a laundry distributing step S100 and a spinning step S200. The laundry distributing step S100 serves to uniformly distribute the laundry inside the drum to reduce occurrence of unbalance. The spinning step S200 serves to substantially remove water of the laundry by increasing the rotation speed of the drum at a relatively high speed. However, it is to be understood that the laundry distributing step and the spinning step are classified for convenience based on their main functions and are not limited to their main functions. For example, even in the laundry distributing step, water may be removed from the laundry by rotation of the drum.

The laundry distributing step S100 includes a wet laundry sensing step S110, a laundry disentangling step S130, and an unbalance sensing step S150. The spinning step S200 can be divided into a main spinning step S260 for substantially carrying out spinning at a predetermined speed and an accelerating step S250 for reaching the main spinning step S260. In this case, the accelerating step S250 means that acceleration is carried out to reach the main spinning step. However, the accelerating step 250 is not intended to carry out acceleration continuously without deceleration or constant speed. In other words, the accelerating step S250 includes an acceleration step together with deceleration and constant speed steps.

First of all, the laundry distributing step S100 will be described in more detail.

If the rinsing cycle ends, the laundry inside the drum is wetted. A control part initially senses the amount of laundry inside the drum, i.e., the amount of wet laundry if the spinning cycle starts (S110). The reason why that the control part senses the amount of wet laundry is that weight of laundry containing water is different from that of dry laundry even though the control part initially senses the amount of laundry, which is not wet, i.e., the amount of dry laundry. The sensed amount of wet laundry may be used as a factor that determines an allowable condition for accelerating the drum at the spinning step S200 or determines a rotation speed Tf-RPM of the drum at the main spinning step S260.

The amount of wet laundry is sensed by accelerating the drum at a predetermined speed A-RPM, generally within the range of 108 RPM and decelerating the drum by braking power. Since this sensing of the amount of wet laundry is widely known, its detailed description will be omitted. After sensing the amount of wet laundry, the control part carries out the laundry disentangling step to distribute the laundry inside the drum (S130). The laundry disentangling step is to uniformly distribute the laundry inside the drum, thereby preventing an unbalance rate of the drum from being increased by concentration of the laundry on a specific region. This is because that vibration increases when the rotation speed of the drum increases if the unbalance rate is increased. Subsequently, the control part senses the unbalance rate (S150). If the laundry inside the drum is not distributed uniformly but concentrated on a predetermined region, the unbalance rate is increased, whereby vibration may be caused when the rotation speed of the drum is increased. Accordingly, the control part determines whether to accelerate the drum by sensing the unbalance rate of the drum. Unbalance sensing is carried out using the difference in acceleration when the drum is rotated. Namely, when the drum is rotated, the difference in acceleration between the case where the drum is rotated downwardly and the case where the drum is rotated upwardly occurs depending on an unbalance level. The control part measures this difference in acceleration by using a speed sensor such as a hole sensor provided in a driving motor, thereby sensing the unbalance rate. Accordingly, if the unbalance rate is sensed, the laundry inside the drum sticks to an inner wall of the drum without dropping even though the drum is rotated. In this case, the drum is rotated in the range of 108 RPM, approximately.

The spinning step S200 will be described in more detail.

As described above, the spinning step S200 can be divided into a main spinning step S260 for substantially carrying out spinning at a predetermined speed Tf-RPM and an accelerating step S250 for reaching the main spinning step S260. In order to reach the main spinning step, i.e., main spinning speed Tf-RPM, the rotation speed of the drum should pass through the transient vibration region R1 and the irregular vibration region R2. As described above, if the transient vibration region R1 has natural vibration characteristics determined by the structure of the laundry machine, and is in the range of 200 RPM to 350 RPM, approximately.

According to the studies of the inventor of the present invention, the irregular vibration region R2 is regarded as specific vibration characteristics of the embodiment of the present invention. Such irregular vibration is not always generated but is likely to be generated relatively. The irregular vibration was occurred in the range of 400 RPM to 1000 RPM, approximately.

When the rotation speed of the drum passes through the transient vibration region R1 and the irregular vibration region R2, great vibration occurs irregularly in the laundry machine. Accordingly, it is preferable that the control part appropriately controls rotation of the drum to allow the drum to effectively pass through the transient vibration region R1 and the irregular vibration region R2. Since many suggestions for the transient vibration region R1 have been provided, detailed description of the transient vibration region R1 will be omitted herein. Hereinafter, the control method of the irregular vibration region R2 will mainly be described.

In this embodiment, the control method of the irregular vibration region R2 includes an irregular vibration region determining step for determining the irregular vibration region R2 of the laundry machine and a balancing step for carrying out balancing by rotating the drum at a predetermined balancing speed for a predetermined time based on the determined irregular vibration region R2 to allow the ball to be located in an opposite position of an unbalanced position.

Preferably, the balancing step is carried out at least one time before the rotation speed of the drum belongs to the irregular vibration region R2, while the rotation speed of the drum is passing through the irregular vibration region R2, and after the rotation speed of the drum passes through the irregular vibration region R2. This is because that balanced balls may be likely to be detached from the balancing position as irregular vibration is likely to occur at the irregular vibration region R2. This is also because that greater vibration may occur due to unbalance as the ball becomes unbalanced if it is not located at the opposite position of the unbalanced position. Accordingly, if balancing is carried out at least one time before the rotation speed of the drum belongs to the irregular vibration region R2, while the rotation speed of the drum is passing through the irregular vibration region R2, and after the rotation speed of the drum passes through the irregular vibration region R2, vibration of the laundry machine due to irregular vibration that may occur can be reduced. Also, if balancing is carried out at least one time before the rotation speed of the drum belongs to the irregular vibration region R2, while the rotation speed of the drum is passing through the irregular vibration region R2, and after the rotation speed of the drum passes through the irregular vibration region R2, it is advantageous in that water is removed form the laundry as the spinning step is carried out, and that unbalancing occurring due to the difference in the spinning amount of laundry can be compensated.

Each balancing carried out before the rotation speed of the drum belongs to the irregular vibration region R2, while the rotation speed of the drum is passing through the irregular vibration region R2, and after the rotation speed of the drum passes through the irregular vibration region R2 will be described as follows.

First of all, balancing (first balancing) carried out before the rotation speed of the drum belongs to the irregular vibration region R2 will be described.

It is preferable that the drum is maintained at a predetermined balancing speed B1-RPM (hereinafter, referred to as "first balancing speed") for a predetermined time t1 before the rotation speed of the drum belongs to the irregular vibration region R2. In this case, since the ball can be located relatively exactly at the opposite position of the unbalanced position one more time before the drum belongs to the irregular vibration region R2, unbalance can be compensated relatively exactly, whereby irregular vibration that may occur can be avoided. Also, even though the ball is detached from the compensation position while the drum is passing through the irregular vibration region R2, vibration can be reduced as compared with that balancing is not carried out before the rotation speed of the drum belongs to the irregular vibration region R2.

Preferably, the first balancing speed B1-RPM is selected such that the ball can be balanced effectively in view of the structure of the ball balancer. The ball is not balanced effectively at every rotation speed of the drum. If the rotation speed of the drum is too small, balancing effect is deteriorated. According to the studies of the inventor of the present invention, when the rotation speed of the drum is in the range of 200 RPM to 800 RPM, approximately, the ball was balanced effectively. Especially, the ball was balanced effectively in case of low speed and constant speed.

Accordingly, it is preferable that the first balancing speed B1-RPM is selected from any one of 200 RPM to 800 RPM. More preferably, the first balancing speed B1-RPM is selected from any one of 200 RPM to 800 RPM after the rotation speed of the drum passes through the transient vibration region R1. This is because that the ball may be detached from the balancing position due to transient vibration when the first balancing speed B1-RPM is selected from the speed of the transient vibration region.

Finally, if the irregular vibration region R2 is in the range of 400 RPM to 1000 RPM, approximately and the transient vibration region R1 is in the range of 200 RPM to 350 RPM, approximately, it is preferable that the first balancing speed B1-RPM is selected from the range of 350 RPM to 400 RPM, approximately. As a result of the studies of the inventor of the present invention, the first balancing speed was preferably in the range of 380 RPM. Also, the first balancing speed B1-RPM was preferably maintained in the range of 30 seconds to 60 seconds.

Next, balancing (second balancing) carried out while the drum is passing through the irregular vibration region R2 will be described.

It is preferable that the drum is maintained at a predetermined balancing speed B2-RPM (hereinafter, referred to as "second balancing speed") for a predetermined time t2 even at the irregular vibration region R2. This is because that irregular vibration may be likely to occur at the irregular vibration region R2 and thus the ball may be detached from the balancing position while passing through the irregular vibration region R2. Accordingly, it is preferable that balancing is carried out one more time while the rotation speed of the drum is passing through the irregular vibration region R2, so as to allow the ball to be located exactly at the opposite position of the unbalanced position.

Preferably, the second balancing speed B2-RPM is selected such that the ball can be balanced effectively (200 RPM to 800 RPM) in view of the structure of the ball balancer. Accordingly, if the irregular vibration region R2 is in the range of 400 RPM to 1000 RPM, approximately, the second balancing speed B2-RPM is preferably selected from the range of 400 RPM to 800 RPM, approximately. As a result of the studies of the inventor of the present invention, the second balancing speed was preferably in the range of 600 RPM corresponding to an intermediate level of the irregular vibration region R2.

Next, balancing (third balancing) carried out after the rotation of the drum passes through the irregular vibration region R2 will be described with reference to FIG. 11.

In this embodiment, the drum is maintained at a predetermined balancing speed B3-RPM (hereinafter, referred to as "third balancing speed") for a predetermined time t3 after it passes through the irregular vibration region R2. This is because that the ball may be detached from the balancing position after the rotation speed of the drum passes through the irregular vibration region R2 as the balanced ball is distributed due to irregular vibration occurring in the irregular vibration region R2 while the rotation speed of the drum is passing through the irregular vibration region R2. In other words, if balancing is carried out one more time after the rotation speed of the drum passes through the irregular vibration region R2, unbalancing can be compensated stably while the drum is being accelerated at a main spinning speed Tf-RPM or at the main spinning speed, whereby vibration can be reduced.

The third balancing speed B3-RPM may be selected at a specific speed, i.e., a rotation speed greater than that of the irregular vibration region R2 after the rotation speed of the drum passes through the irregular vibration region R2. However, in this case, balancing may not be carried out effectively. Accordingly, it is preferable that the third balancing speed B3-RPM is selected such that the ball can be balanced effectively in view of the structure of the ball balancer. In this respect, if the irregular vibration region R2 is in the range of 400 RPM to 1000 RPM, approximately, the third balancing speed B3-RPM is preferably selected from the range of 400RPM to 800 RPM, approximately. In other words, it is preferable that the drum is decelerated at the third balancing speed B3-RPM for balancing after the rotation speed of the drum passes through the irregular vibration region R2 and then is accelerated to reach the main spinning speed Tf-RPM.

In this case, the rotation speed of the drum again passes through the irregular vibration region R2. According to the studies of the inventor of the present invention, in view of vibration reduction, it was effective that the third balancing is not carried out. In other words, irregular vibration does not always occur and weight of the laundry is reduced and unbalance is also reduced as water is removed from the laundry in accordance with the spinning cycle. Accordingly, the probability of irregular vibration is reduced if the drum is decelerated after its rotation speed passes through the irregular vibration region R2 and then is accelerated again subsequently to balancing.

Also, for third balancing, if the drum is accelerated to reach the main spinning speed Tf-RPM after being decelerated at the third balancing speed B3-RPM, the time required for the main spinning step S260 can be reduced. In other words, when a target water content of the laundry is defined, spinning is carried out even in the case that the drum is accelerated after being decelerated at the third balancing speed B3-RPM. Accordingly, the time required for the main spinning step S260 can be reduced. Generally, a problem may occur in that vibration is caused if the drum is rotated at high speed. However, since the time required for the main spinning step S260 carried out by the drum at the highest rotation speed can be reduced, vibration can be reduced. In other words, as a result of the studies, since vibration occurring in the main spinning step S260 may cause a problem as compared with vibration that may occur when the rotation speed of the drum passes through the irregular vibration region after the third balancing, it was effective that the third balancing prevents vibration from occurring.

In the mean time, as a result of the studies of the inventor of the present invention, it was noted that the third balancing speed B3-RAM is preferably low but should be more than 350 RPM so as not to be again in the range of the transient vibration region. More preferably, it was noted that the third balancing speed B3-RAM is 380 RPM equally to the first balancing speed B1-RPM. In other words, it was preferably noted that the rotation speed of the drum is decelerated at the first balancing speed B1-RPM after passing through the irregular vibration region (Tm-RPM) and then accelerated to reach the main spinning speed Tf-RPM after being maintained at the first balancing speed B1-RPM for a predetermined time.

Figure 12:
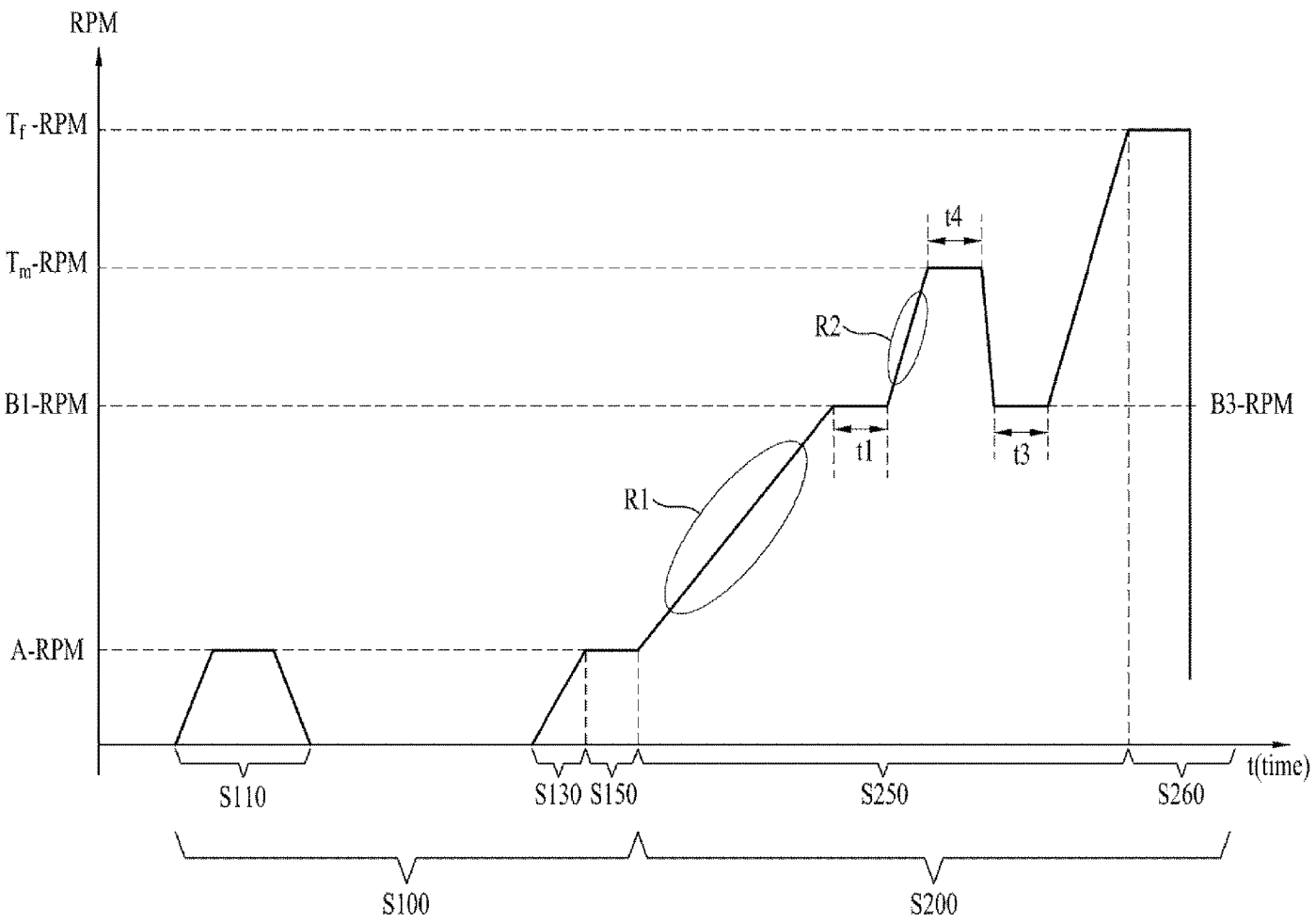
FIG. 12 is a graph illustrating other example of a control method of a laundry machine according to the present invention.

In the mean time, as shown in FIG. 12, the rotation speed of the drum may be maintained at a predetermined constant speed Tm-RPM for a predetermined time t4 without being directly decelerated at the third balancing speed B3-RAM after passing through the irregular vibration region R2. In this case, the water content of the laundry can be more reduced when the rotation speed of the drum is maintained at the predetermined constant speed Tm-RPM for the predetermined time t4. Accordingly, the rotation speed of the drum can be more reduced when it is in the range of the main spinning speed Tf-RPM corresponding to the highest rotation speed. As a result, it is advantageous in that vibration due to high rotation speed can be reduced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Figure 13:
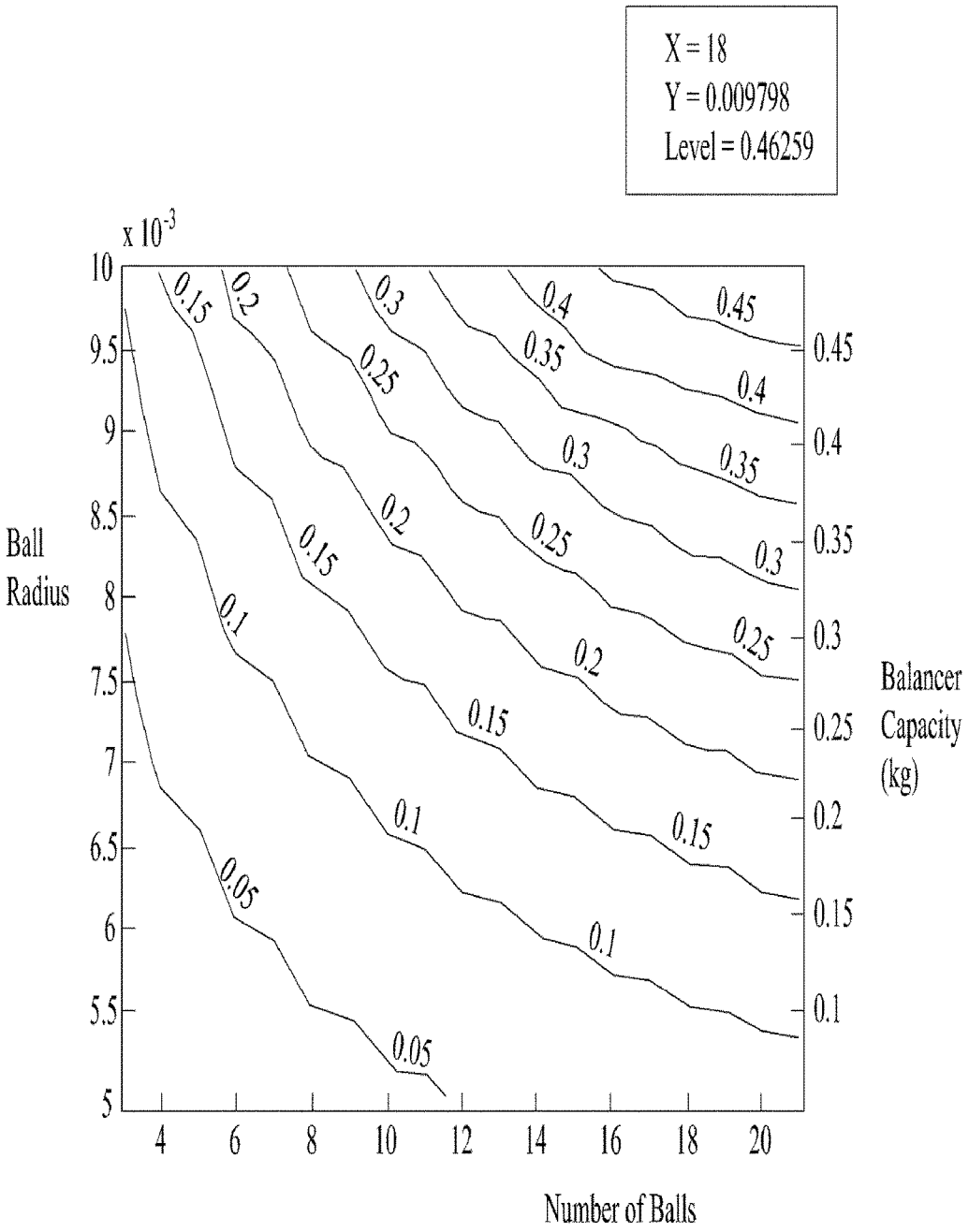
FIG. 13 is a graph illustrating relation among capacity of a ball balancer, the number of balls, and size of the balls.

As shown in FIG. 13, in consideration of noise due to collision of the balls and the size of the ball balancer, it is preferable that the number of the balls be approximately 4~20. Further, if the capacity of the ball balancer is 350 g, the minimal size of the balls is approximately 17 mm.

Figure 14:
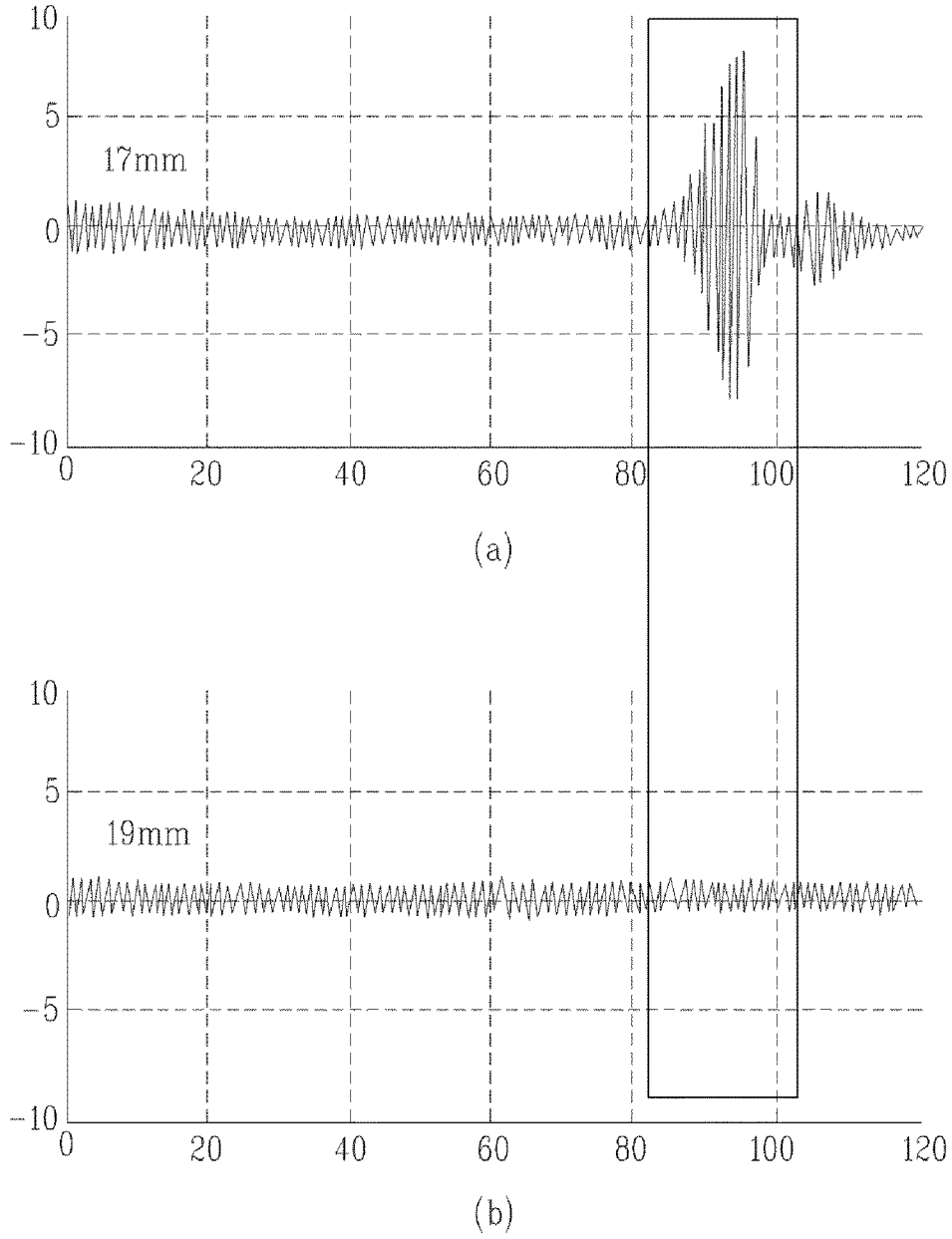
FIGS. 14(*a*) and 14(*b*) are graphs illustrating vibration characteristics according to size of balls.
Figure 15:
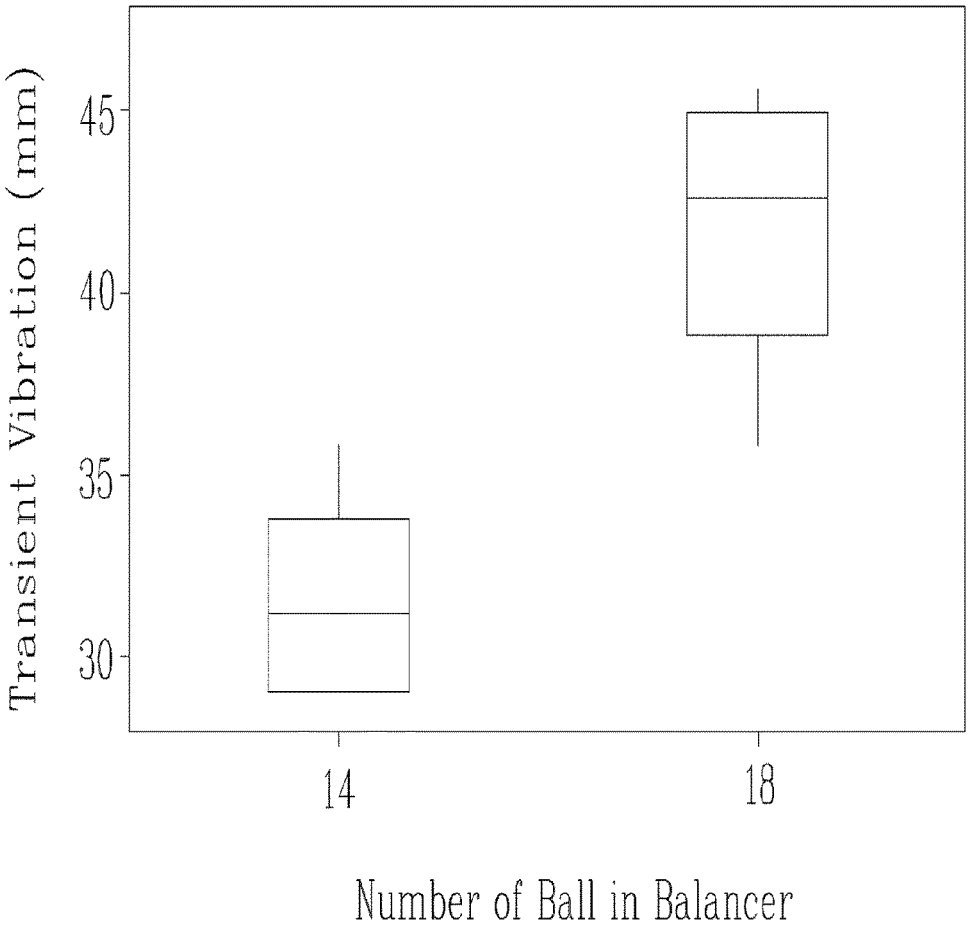
FIG. 15 is a graph illustrating vibration characteristics according to the number of balls.

According to the research results of the inventor(s) of the present invention, in the laundry machine accordance with this embodiment, if balls having a size of 17 mm determined by the theoretical function are used, irregular vibration occurred, and if balls having a size of more than 17 mm are used, irregular vibration did not occur, as shown in FIGS. 14(*a*) and 6(*b*). Further, vibration in the transient vibration region if the number of the balls corresponding to the size of 17 mm is 18 was also greater than vibration in the transient vibration region if the number of the balls corresponding to the size of 19 mm is 14.

It is thought that during actual operation of the laundry machine, the size of the balls determined by the theoretical function is excessively small, and thus centrifugal force applied to the balls is reduced and frictional force to prevent movement of the balls is reduced, and thereby positions of the balls are diffused and cause irregular vibration. Therefore, it is preferable that the size of the balls be larger than the size determined by the theoretical function and the number of the balls be determined based on the obtained size of the balls.

Next, the shapes of the race 312*a* of the ball balancer 310 will be described, with reference to FIGS. 16(*a*) to 8(*c*).

It is preferable that the shape of the race 312*a*, the size of the race 312*a*, the size of the balls 312, and the viscosity of the oil 312*b* be determined in consideration of vibration characteristics of the laundry machine. FIG. 16(*a*) illustrates the race 312*a* having a substantially square cross-sectional shape in which the cross-sectional area of the ball 312 is 437 $mm^2$ and the cross-sectional area of the race 312*a* except for the ball 312 is 152 $mm^2$, FIG. 16(*b*) illustrates the race 312*a* having a substantially square cross-sectional shape in which the cross-sectional area of the ball 312 is 412 $mm^2$ (reduced by 6% compared with the race 312*a* of FIG. 16(*a*)) and the cross-sectional area of the race 312*a* except for the ball 312 is 127 $mm^2$ (reduced by 16% compared with the race 312*a* of FIG. 16(*a*)), and FIG. 16(*c*) illustrates the race 312*a* having a substantially rectangular cross-sectional shape.

Figure 16:
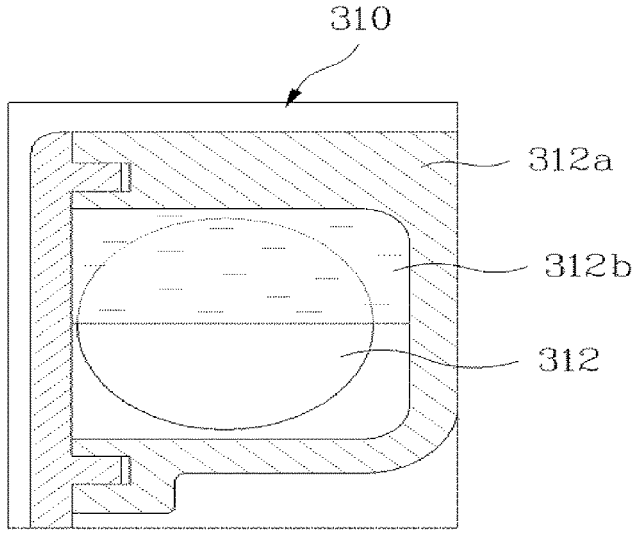
FIGS. 16(*a*) to 16(*c*) are longitudinal-sectional views schematically illustrating race structures applied to the ball balancer.
Figure 16:
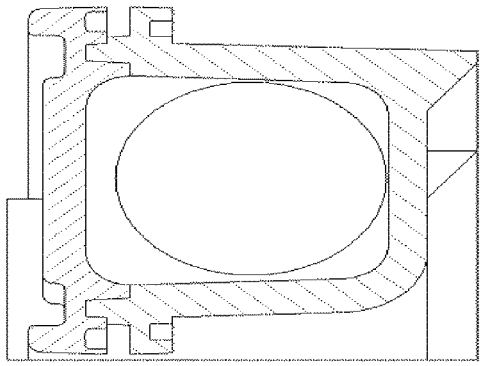
Figure 16:
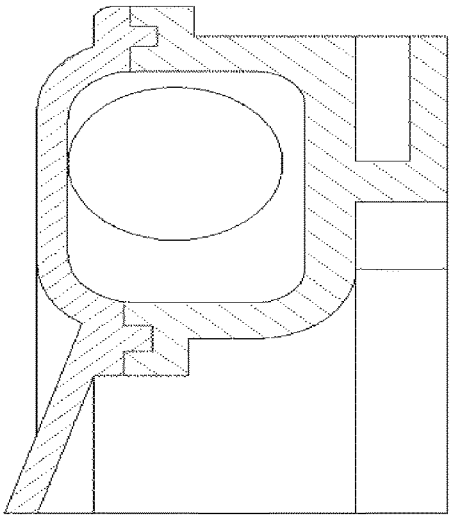
Figure 17:
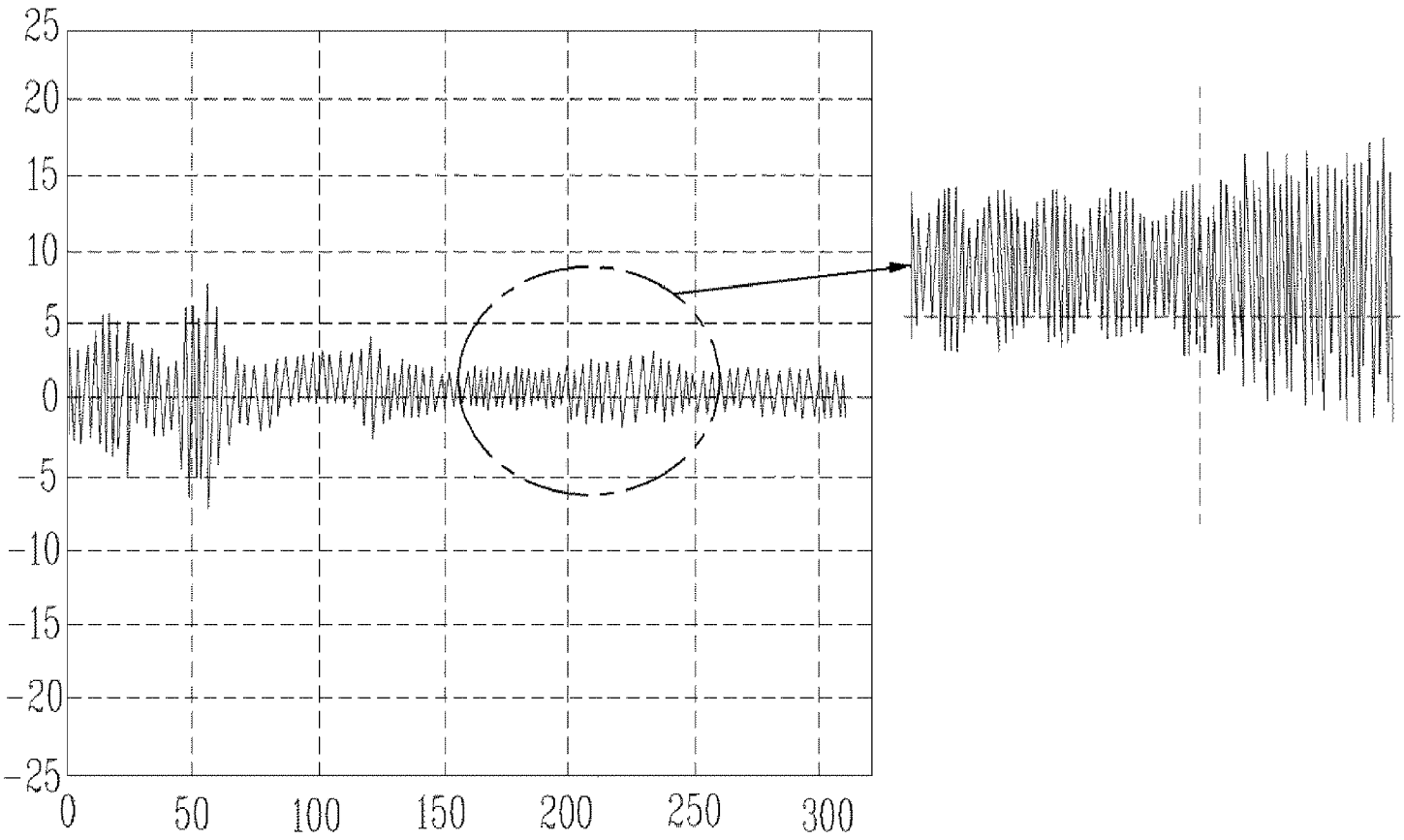
FIG. 17 is a graph illustrating vibration characteristics according to race structure of the ball balancer.

According to the research results, the races 312*a* having a substantially rectangular cross-sectional shape, as shown in FIGS. 16(*a*) and 16(*b*), were advantageous. That is, the races 312*a* of FIGS. 16(*a*) and 16(*b*) have similar performances in the transient vibration region and the steady-state vibration region, and the race 312*a* of FIG. 16(*b*) has excellent performance in the irregular vibration region. However, the race 312*a* of FIG. 16(*c*) generates high vibration in the irregular vibration region, as shown in FIG. 17. It is thought that the race 312*a* of FIG. 16(*c*) has a large cross-sectional shape and thus movement of the balls 312 easily occurs. Therefore, it is preferable that the race have a substantially square cross-sectional shape. Further, it is preferable that the balls be comparatively densely distributed in the race.

Figure 18:
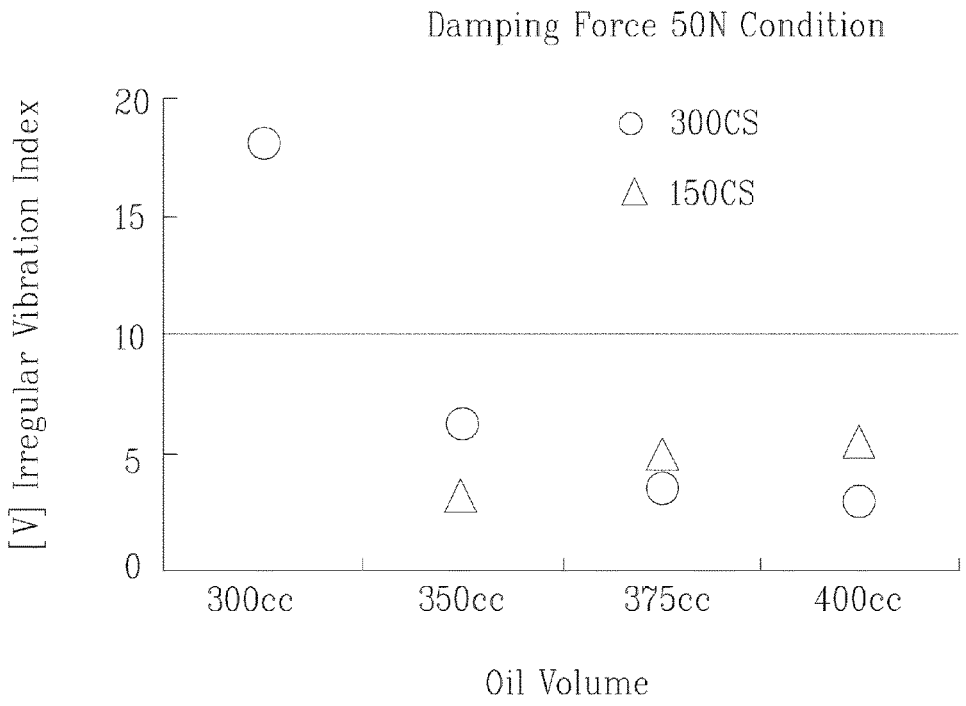
FIG. 18 is a graph illustrating vibration characteristics according to viscosity and filling amount of oil of the ball balancer.

Next, the viscosity of the oil and the filling amount of the oil in the race, i.e., a filling ratio of the oil will be described, with reference to FIG. 18.

As research results, it is thought that the viscosity of the oil and the filling ratio of the oil also affect irregular vibration. First, if the amount of the oil is less than approximately 350 cc, irregular vibration was impermissibly high. Therefore, it is preferable that the amount of the oil be more than 350 cc. If the amount of the oil is more than 350 cc, a difference in generation of the irregular vibration was not remarkable. However, if the amount of the oil is increased, the amount of the oil caused a large resistance to movement of the balls and it was difficult to sense unbalance of laundry in the drum. That is, an unbalance sensing time and dispersion were increased. Therefore, it is preferable that the amount of the oil be 300 cc. Further, the amount of the oil is regarded as the filling ratio (amount of oil/inner volume of race) in connection with the shape of the race 132*a*, and the filling ratio is preferably more than 40%, and more preferably more than 60%.

Further, if the viscosity of the oil is less than a designated value, i.e., less than at least 300 CS at room temperature, generation of irregular vibration become issue. Therefore, it is preferable that the viscosity of the oil be more than 300 CS.

The invention claimed is:

1. A control method of a laundry machine provided with a ball balancer for performing a balancing in a spinning cycle, the control method comprising:

sensing unbalance of a drum at least one time before a rotation speed of the drum passes through a transient region, wherein the transient region is a region where a rotation speed of the drum is close to a normal vibration mode of the laundry machine;

determining an irregular vibration region of the laundry machine as a region corresponding to the rotation speed of the drum when vibration of the drum increases after it passes through the transient region and becomes steady, the irregular vibration region corresponding to a rotation speed of the drum that is greater than the rotation speed of the drum at the transient region; and performing at least one time first balancing of the drum at a first constant speed before the irregular vibration region, performing acceleration of the drum, performing at least one time second balancing of the drum while passing through the irregular vibration region, wherein the drum is maintained at a second constant speed for a predetermined time, in response to an end of the predetermined time of maintaining the drum at the second constant speed then decreasing the rotation speed of the drum, and performing at least one time third balancing of the drum at the first constant speed after passing through the irregular vibration region.

2. The control method as claimed in claim 1, wherein the transient region is defined as a RPM region between a start rotational speed and an end rotational speed, wherein the end rotational speed is higher than a rotational speed calculated by adding a value of 30% of the start rotational speed to the start rotational speed.

3. The control method as claimed in claim 1, wherein the transient region comprises a RPM band of 200 to 350 rpm.

4. The control method as claimed in claim 1, wherein sensing the unbalance is implemented at a balancing RPM band of 150 to 200 RPM before the rotational speed of the drum passes the transient region.

5. The control method as claimed in claim 1, wherein the laundry machine comprises a driving unit comprising a shaft connected to a drum, a bearing housing to rotatably support the shaft, and a motor to rotate the shaft, and a suspension assembly is connected to the driving unit.

6. The control method as claimed in claim 1, wherein the laundry machine comprises a rear gasket for sealing to prevent washing water from leaking from a space between a driving unit and a tub, and enabling the driving unit to move relative to the tub.

7. The control method as claimed in claim 1, wherein a tub is supported more rigidly than a drum being supported by a suspension assembly.

8. The method as claimed in claim 1, wherein the first balancing is performed at a rotation speed of 350 rpm to 400 rpm.

9. The method as claimed in claim 1, wherein the second balancing is performed at a rotation speed of 350 rpm to 1000 rpm.

* * * * *